US006859634B2

(12) United States Patent
Itoh et al.

(10) Patent No.: US 6,859,634 B2
(45) Date of Patent: Feb. 22, 2005

(54) TONER REFILLING DEVICE AND DEVELOPING DEVICE USING THE SAME FOR AN IMAGE FORMING APPARATUS

(75) Inventors: Fumihito Itoh, Kawasaki (JP); Shunji Katoh, Sagamihara (JP); Hirosato Amano, Numazu (JP); Kunio Makino, Mishima (JP); Takamichi Enomoto, Numazu (JP); Hiroyuki Uemura, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/354,041

(22) Filed: Jan. 30, 2003

(65) Prior Publication Data

US 2003/0170049 A1 Sep. 11, 2003

(30) Foreign Application Priority Data

Jan. 31, 2002 (JP) ..... 2002-023250
Mar. 11, 2002 (JP) ..... 2002-065836

(51) Int. Cl.[7] ..... G03G 15/08
(52) U.S. Cl. ..... 399/258; 399/399; 399/27
(58) Field of Search ..... 399/12, 13, 25, 399/27–29, 258

(56) References Cited

U.S. PATENT DOCUMENTS

| | | | | |
|---|---|---|---|---|
| 4,304,273 | A | 12/1981 | Caudill et al. | |
| 5,468,711 | A | 11/1995 | Suzuki et al. | |
| 5,525,573 | A | 6/1996 | Uemura et al. | |
| 5,547,915 | A | 8/1996 | Suzuki et al. | |
| 5,596,395 | A | 1/1997 | Sawamura et al. | |
| 5,597,774 | A | 1/1997 | Uemura et al. | |
| 5,686,382 | A | 11/1997 | Suzuki et al. | |
| 5,726,121 | A | 3/1998 | Uemura et al. | |
| 5,750,299 | A | 5/1998 | Ohshima et al. | |
| 5,834,396 | A | 11/1998 | Uemura et al. | |
| 5,909,609 | A | 6/1999 | Yahata et al. | |
| 5,950,055 | A | 9/1999 | Yahata et al. | |
| 5,950,062 | A | 9/1999 | Yahata et al. | |
| 5,958,832 | A | 9/1999 | Uemura et al. | |
| 5,966,564 | A | 10/1999 | Kizaki et al. | |
| 6,091,912 | A | 7/2000 | Kitajima et al. | |
| 6,097,903 | A | 8/2000 | Yahata et al. | |
| 6,118,951 | A | 9/2000 | Kato et al. | |
| 6,151,471 | A | 11/2000 | Yahata et al. | |
| 6,198,895 | B1 | 3/2001 | Tsuda et al. | |
| 6,337,957 | B1 | 1/2002 | Tamaki et al. | |
| 6,385,407 | B1 * | 5/2002 | Inose | 399/12 |
| 6,522,855 | B1 | 2/2003 | Katoh et al. | |
| 2001/0051062 | A1 | 12/2001 | Yanagisawa et al. | |
| 2001/0052526 | A1 | 12/2001 | Kasahara et al. | |

FOREIGN PATENT DOCUMENTS

| | | |
|---|---|---|
| JP | 2000-227704 | 8/2000 |
| JP | 2000-246921 | 9/2000 |
| JP | 2000-338760 | 12/2000 |
| JP | 2002-40777 | 2/2002 |

* cited by examiner

*Primary Examiner*—Arthur T. Grimley
*Assistant Examiner*—Ryan Gleitz
(74) *Attorney, Agent, or Firm*—Oblon, Spivak, McClelland, Maier & Neustadt, P.C.

(57) ABSTRACT

In a developing device of the present invention for depositing toner on an image carrier to thereby develop a latent image formed thereon, a toner refilling device is configured to refill, when the toner is short, fresh toner at a position where the developing device is situated.

3 Claims, 29 Drawing Sheets

| |
|---|
| FIG. 5A |
| FIG. 5B |
| FIG. 5C |

TONER REFILLING DEVICE AND DEVELOPING DEVICE USING THE SAME FOR AN IMAGE FORMING APPARATUS

BACKGROUND OF THE INVENTION

1. Field of the Invention

The present invention relates to a copier, facsimile apparatus, printer or similar image forming apparatus for forming a toner image on an image carrier with toner fed from a toner container. Mote particularly, to a toner refilling device for refilling fresh toner in a toner container run out of toner and a developing device using the same.

2. Description of the Background Art

It is a common practice with an image forming apparatus to form a latent image on a photoconductive element or image carrier and develop the latent image with toner or similar developer. The toner, which has critical influence on image density, is consumed due to repeated development, so that fresh toner must be replenished, as needed.

An image forming apparatus of the type using a toner cartridge, toner bottle, toner hopper or similar toner container is conventional. In this type of apparatus, when the toner container runs out of toner due to consumption, it is usually replaced with a new toner container filled with fresh toner. However, discarding the empty toner container is not desirable from the environment and resource standpoint. In light of this, some different recycling methods have recently been proposed for refilling the empty toner container with fresh toner and again putting it on the market.

In accordance with one conventional recycling method, the empty toner container is collected from the user's station, cleaned in a recycling factory, and then refilled with fresh toner. In accordance with another recycling method, the toner container collected from the user's station is pulverized to produce a resource, and then a toner container is reproduced from the resource and filled with fresh toner.

However, the problem with the conventional recycling methods is that the empty toner container must be collected from the user's station, transported to a recycling factory, and then refilled with fresh toner. Such a procedure increases the recycling cost and time and is therefore undesirable for both of the user and manufacturer.

On the other hand, the toner container is provided with a preselected volume in accordance with the amount of toner to store. It follows that an increase in the amount of toner to store directly translates into an increase in the size of the toner container and therefore in a space necessary for accommodating it. This increases the size of the developing device and therefore the overall size of the image forming apparatus including it.

When the toner container is reduced in size to prevent the size of the image forming apparatus from increasing, the toner container must be frequently replaced when toner is consumed at a high rate, resulting in an increase in running cost. Further, image formation must be interrupted every time the toner container is replaced. Moreover, when the toner cartridge is collected from the user's station and then refilled, the recycling cost and time are increased, as stated earlier.

Japanese Patent Application No. 2001-71152 discloses a portable, toner refilling device that can be carried to any desired location and then operated to refill a toner container there. For example, a service person may carry the toner refilling device to the user's station and refill an empty toner container instead of collecting the empty toner container. It is therefore not necessary to discard the empty toner container or recycle it at high cost.

However, the toner refilling device stated above has a problem that a service person is apt to take one toner container for another toner container or one toner for another toner during the refilling operation performed at the user's station. This is particularly true when a plurality of image forming apparatuses are situated at the user's station. In fact, various types of image forming apparatuses each using a particular toner container and a particular kind of toner are operated on the market. So long as toner containers are refilled under control in a factory, it is least likely that the toner containers or toners are mixed up despite the fact that the configuration of the toner container and the kind of toner depend on the type of the image forming apparatus. This is because a system for strictly controlling a refilling line is established in a factory.

The problem stated above is likely to occur not only at the user's station but also at, e.g., a service company where the system for controlling the refilling procedure is not so strict as in a factory.

Technologies relating to the present invention are also disclosed in, e.g., Japanese Patent Laid-Open Publication Nos. 2000-227704, 2000-246921, 2000-338760 and 2002-40777.

SUMMARY OF THE INVENTION

It is an object of the present invention to provide a developing device capable of being rapidly refilled with a developer to thereby obviate an increase in cost and the interruption of image formation ascribable to frequent replacement, and an image forming apparatus using the same.

It is another object of the present invention to provide a toner refilling device configured to prevent a service person from putting the wrong toner container in an image forming apparatus or refilling a toner container with the wrong toner, and image forming apparatus using the same.

In accordance with the present invention, in a developing device for depositing toner on an image carrier to thereby develop a latent image formed thereon, a toner refilling device is configured to refill, when the toner is short, fresh toner at a position where the developing device is situated.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the present invention free from the problems of the conventional technologies discussed earlier will be described hereinafter.

First Embodiment

Figure 1:
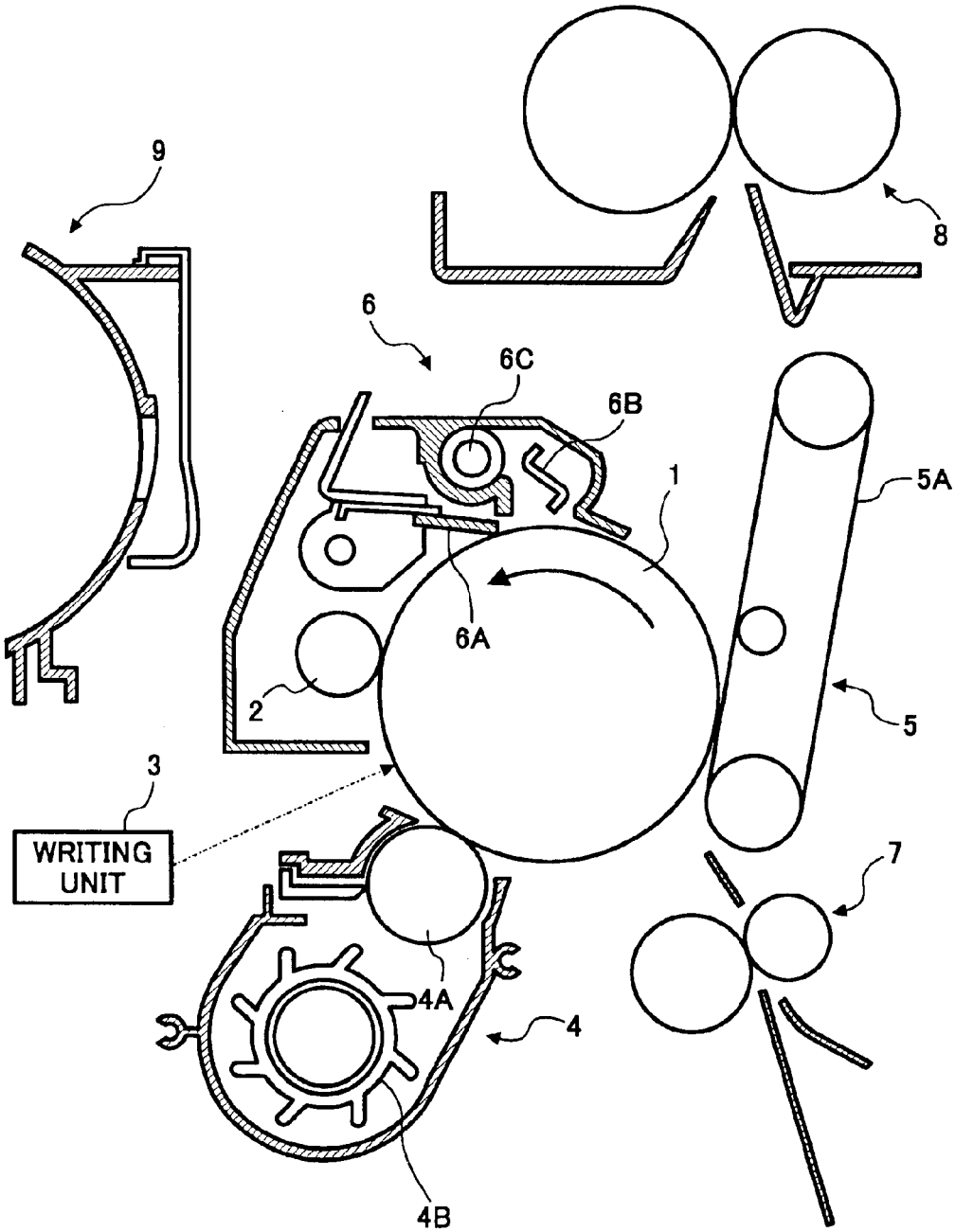
FIG. 1 shows an image forming apparatus including a first embodiment of the developing device in accordance with the present invention.

Referring to FIG. 1 of the drawings, an image forming apparatus to which a developing device embodying the present invention is applied is shown. The image forming apparatus is implemented as a printer of the type forming a latent image on an image carrier in accordance with image data although it may, of course, be implemented as, e.g., a copier or a facsimile apparatus.

As shown in FIG. 1, the printer includes a photoconductive drum or image carrier 1 rotatable in a direction indicated by an arrow. Arranged around the drum 1 are a charge roller or charging device 2, an optical writing unit 3, a developing device 4, an image transferring device 5, and a cleaning device 6. The charge roller 2 uniformly charges the surface of the drum 1 being rotated. The optical writing unit 3 scans the charged surface of the drum 1 with a light beam in accordance with image data, thereby forming a latent image on the drum 1. The developing device 4 develops the latent image with toner to thereby produce a corresponding toner image. The image transferring device 5 transfers the toner image from the drum 1 to a sheet, which is fed from a registration roller pair 7 at preselected timing.

In the illustrative embodiment, the image transferring device 5 includes an endless belt 5A configured to electrostatically attract the sheet due to the action of a charger not shown. More specifically, the sheet is shifted toward the belt 5A due to the electrostatic attraction and peeling effected by the curvature of the drum 1 at the position where the attraction acts. The belt 5A conveys the sheet toward a fixing device 8 while retaining it thereon. The sheet with the toner image fixed thereon by the fixing device 8 is driven out to, e.g., a print tray not shown.

After the image transfer, the cleaning device 6 removes the toner left on the drum 1 with a blade 6A. Subsequently, a quenching lamp, not shown, dissipates charge left on the drum 1 for thereby preparing the drum 1 for the next image formation. The toner scraped off by the blade 6A is collected by a blade 6B and then conveyed by an auger or similar conveying means 6C toward the developing device 4. The toner thus returned to the developing device 4 is again used for development.

Figure 2:
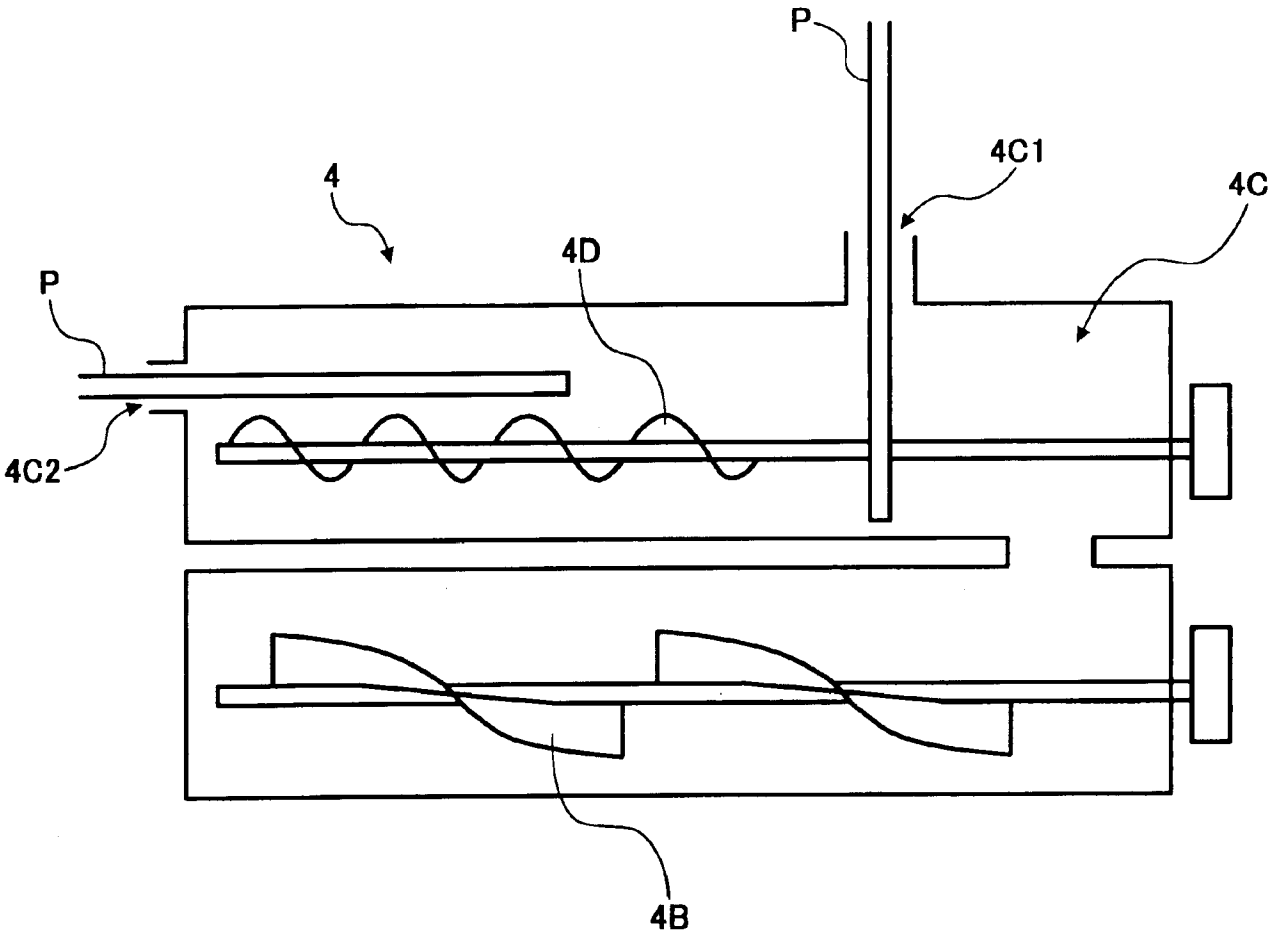
FIG. 2 is a view showing a toner replenishing section forming part of the developing device.

In the illustrative embodiment, the developing device 4 uses a two-ingredient type developer made up of carrier grains formed of iron and toner grains formed of a dielectric material and deposited on the carrier grains. The developing device 4 includes a developing section including a sleeve 4A for depositing the developer on the drum 1 and a paddle wheel 4B for charging the toner by agitating the developer. As shown in FIG. 2, the developing device 4 additionally includes a toner replenishing section including a toner hopper 4C implemented by a space fluidly communicated to the space where the paddle wheel 4B is located. A screw 4D for conveyance is disposed in the toner hopper 4C.

In the developing device 4, the toner collected from the drum 1 by the cleaning device 6 and fresh toner replenished from the toner hopper 4C via a port 4C1 are agitated together and then introduced into the developer. The screw 4D conveys the resulting mixture from the front toward the rear in a direction perpendicular to the sheet surface of FIG. 1. Subsequently, the paddle wheel 4B conveys the above mixture from the rear toward the front with its blades, thereby circulating the mixture. As shown in FIG. 1, the printer additionally includes a mount portion for mounting a toner bottle or toner replenishing section 10, which will be described with reference to FIG. 5 and successive figures later.

As shown in FIG. 2, the toner hopper 4C is formed with a port 4C2 in addition to the port 4C1. The two ports 4C1 and 4C2, which serve as refilling portions, extend toward the inside of the toner hopper 4C perpendicularly to each other and can be selectively used, as will be described specifically later. Of course, the two ports 4C1 and 4C2 may be replaced with a single port, if desired.

Figure 3:
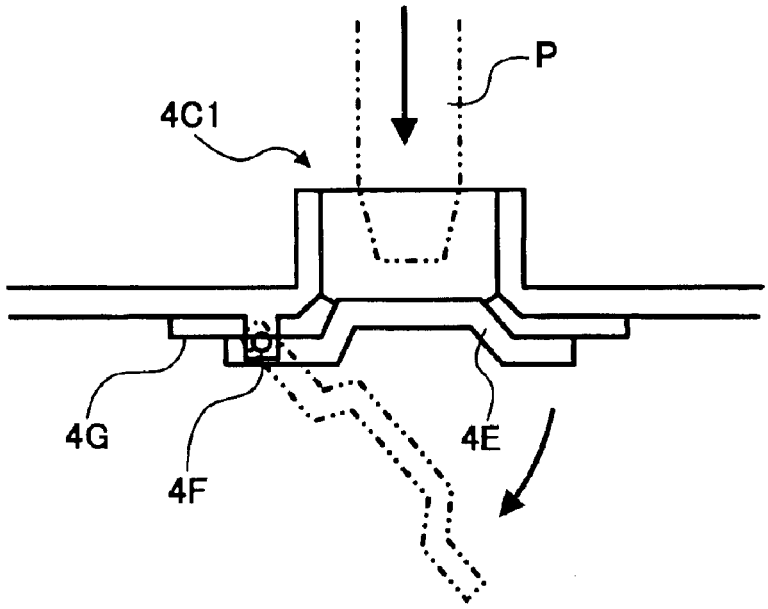
FIG. 3 is a fragmentary view showing a specific configuration of a toner refilling portion included in the toner replenishing section.

The ports 4C1 and 4C2 each are provided with a valve structure capable of being opened only when a nozzle or similar toner refilling member P is inserted from the outside. FIG. 3 shows a specific configuration of the valve structure applied to the port 4C1 extending in the vertical direction, as viewed in FIG. 2. As shown, a lid 4E is hinged to the inner periphery of the toner hopper 4C. A torsion spring 4F is positioned at the portion where the lid 4E is hinged to the toner hopper 4C and constantly biases the lid 4E to a position indicated by a solid line in FIG. 3 where it closes the port 4C1. A mat-like seal member 4G is positioned at a portion where the lid 4E and the inner periphery of the toner hopper 4C face each other, maintaining air-tightness around the port 4C1 when the lid 4E closes the port 4C1. When the toner refilling member P is inserted into the port 4C1, it forces the lid 4E to open. When the toner refilling member P is pulled out, the lid 4E closes the port 4C1 due to the action of torsion spring 4F.

Figure 4A:
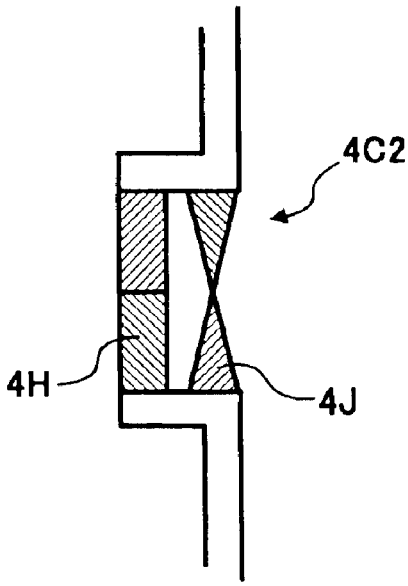
FIGS. 4A and 4B are fragmentary views showing another specific configuration of the toner refilling portion.
Figure 4B:
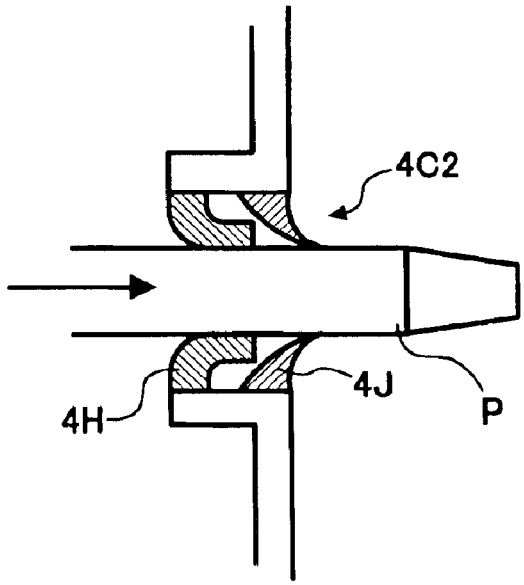

FIGS. 4A and 4B show a specific configuration of the vale structure applied to the other port 4C2 extending in the horizontal direction, as viewed in FIG. 2. As shown, a plurality of flexible seal members 4H and 4J are positioned in the port 4C2 side by side in the horizontal direction. As shown in FIG. 4B, the seal members 4H and 4J each are formed with a slit. When the toner refilling member P is inserted into the slits of the seal members 4H and 4J, the seal members 4H and 4J elastically deform and admit the member P into the toner hopper 4C. When the toner refilling member P is pulled out, the seal members 4H and 4J elastically restore their original positions and close the port 4C2.

Figures 5, 5A:
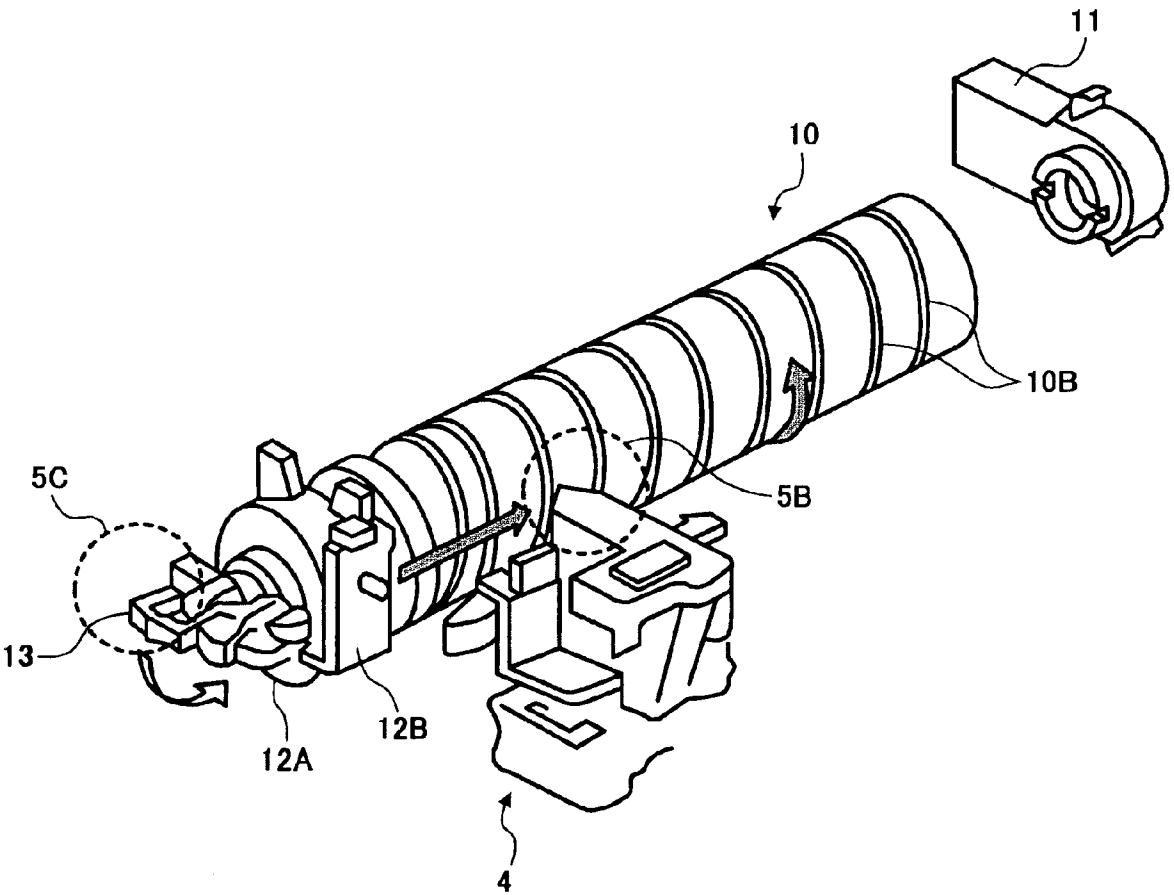
FIG. 5 is an isometric view showing another specific configuration of the toner replenishing section.
Figure 5C:
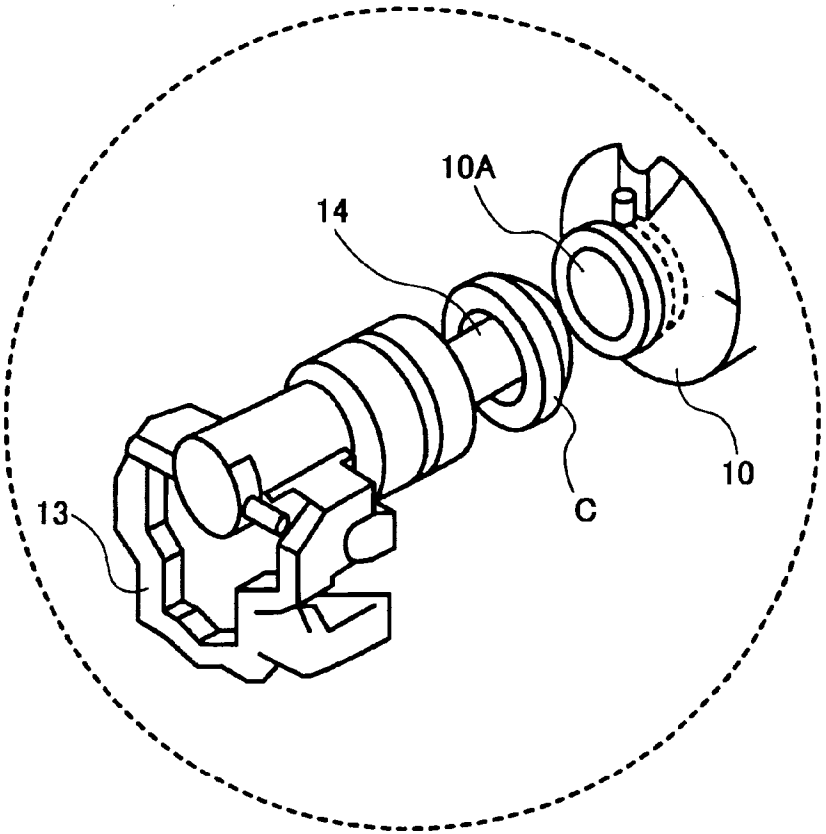
Figure 5B:
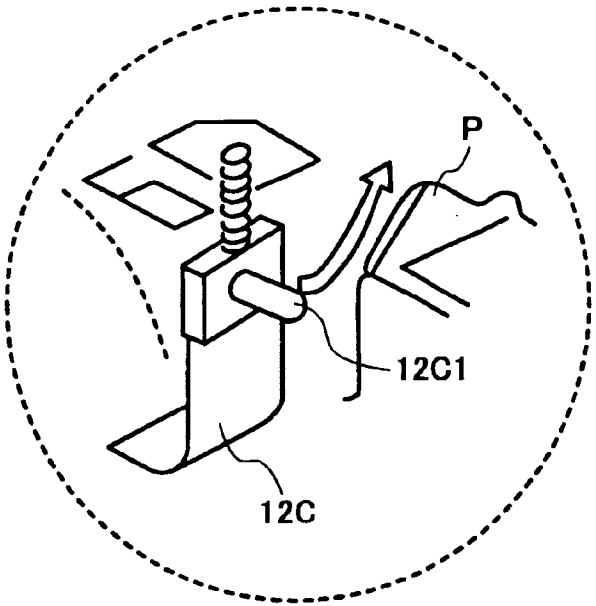

FIG. 5 shows the toner bottle or toner replenishing section 10 specifically. As shown, a toner outlet 10A is formed in the center of one of axially opposite end walls of the toner bottle 10. A spiral ridge 10B is formed in the inner periphery of the toner bottle 10 in such a manner as to protrude into the toner bottle 10. The other axial end wall of the toner bottle 10 is provided with an engaging portion, not shown, engageable with the output shaft 11 A of a motor or a drive device 11. The engaging portion and output shaft 11A mate with each other with a projection and recess arrangement.

Figure 6:
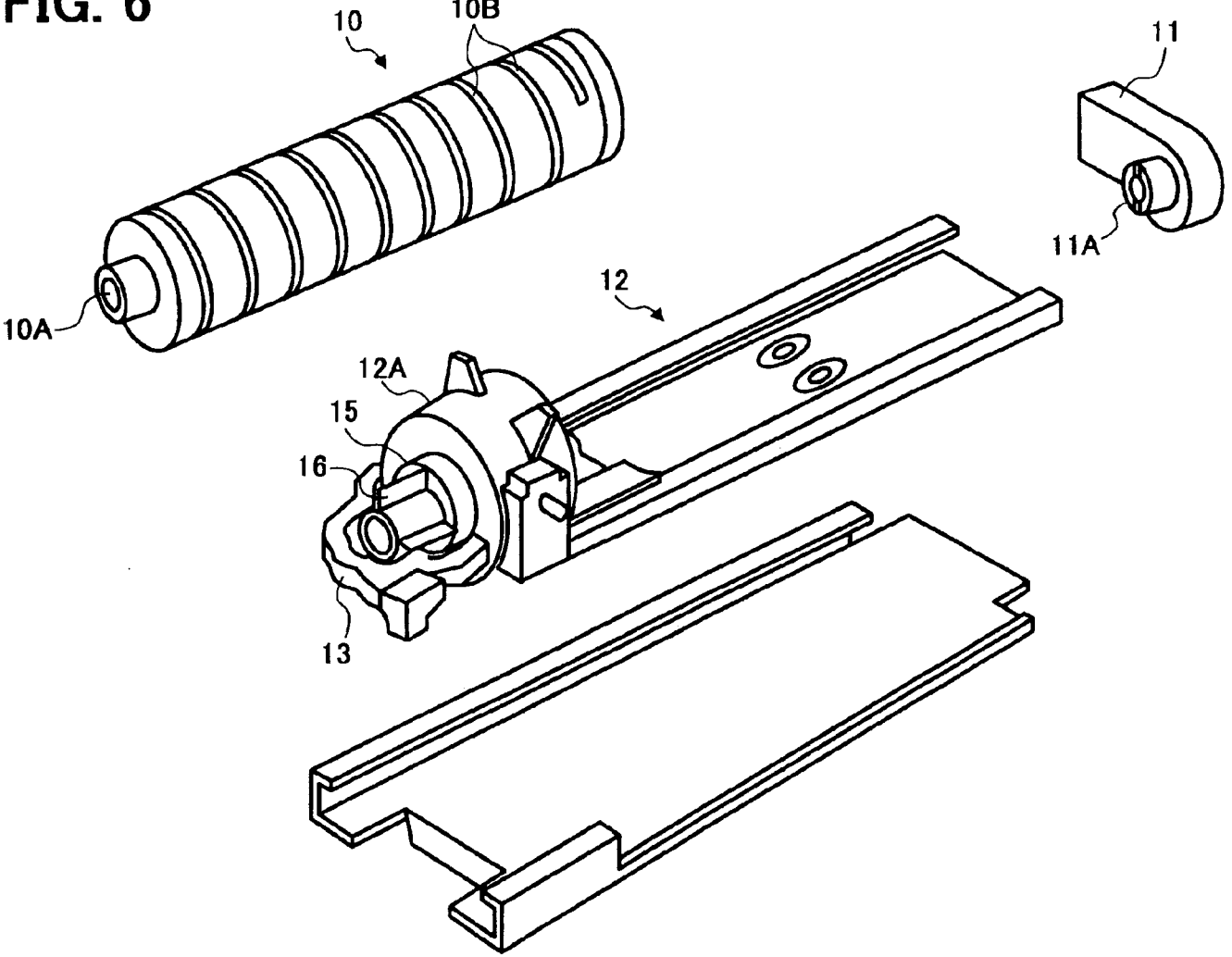
FIG. 6 is an exploded isometric view showing the toner replenishing section of FIG. 5.

As shown in FIG. 6, a base 12 is constructed integrally with a case 12A playing the role of container holding means. The toner bottle 10 is mounted to the case 12A in a substantially horizontal position with the end of the toner outlet 10A being engaged with the case 12A. The case 12A is provided with a set lever or operating member 13 angularly movable to attach or detach a cap C (see FIG. 5) to or from the toner outlet 10A of the toner bottle 10A. As shown in a fragmentary enlarged view in the top left portion of FIG. 5, the set lever 13 is provided with a chuck member 14 capable of pulling out the cap C fitted in the toner outlet 10A in interlocked relation to the movement of the set lever 13.

Figure 7:
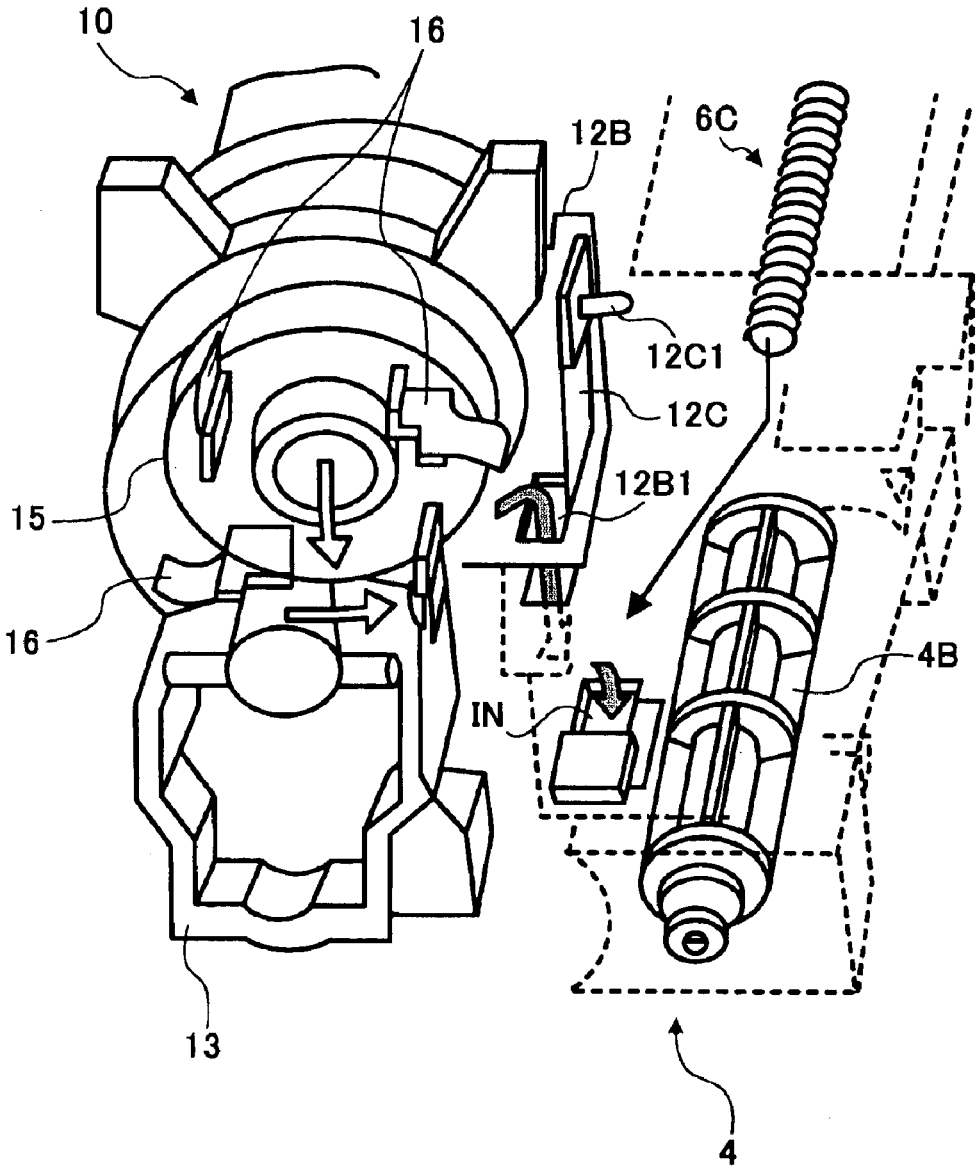
FIG. 7 is a perspective view showing hot toner is replenished from the toner replenishing section.

As shown in FIG. 7, the case 12A includes a bottle holding member 15 rotatable integrally with the toner bottle 10. A plurality of Mylar sheets 16 are fitted on the bottle holding member 14 around an opening fluidly communicated to the toner outlet 10A. The Mylar sheets 16 convey fresh toner driven out of the toner bottle 10 via the toner outlet 10A toward a replenishing position 12B where a toner outlet 12B1 is positioned. As shown in a fragmentary enlarged view in the bottom right portion of FIG. 5, the toner outlet 12B1 is closed by a shutter member 12C until the case 12A has been mounted to the developing device 4. When the case 12A is mounted to the developing device 4, a lug P included in a process cartridge unit, not shown, raises a pin 12C1 studded on the shutter member 12C for thereby opening the toner outlet 12B1.

As shown in FIG. 7, a toner inlet IN is formed in the developing device 4 and capable of being communicated to the toner outlet 12B1 of the toner replenishing section 12B. The toner collected from the drum 1 and conveyed by the auger 6C of the cleaning device 6 is also brought to the toner inlet IN.

Figure 8A:
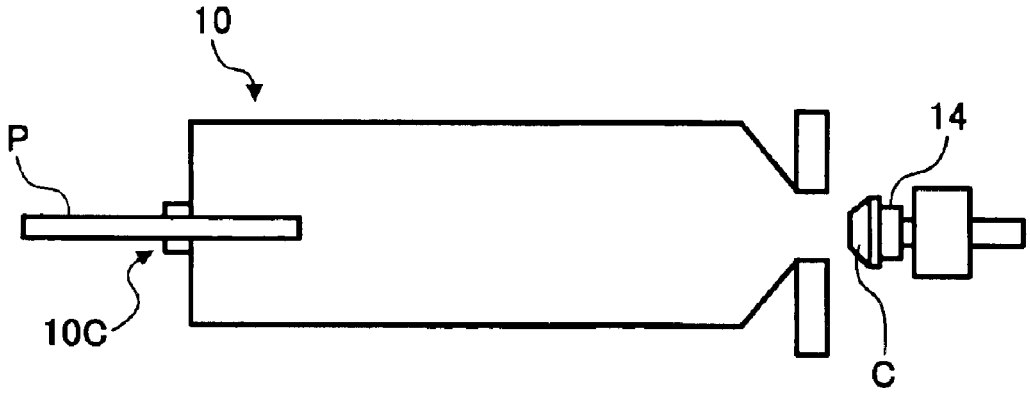
FIGS. 8A and 8B show a specific configuration of the toner refilling portion applied to the toner replenishing section of FIG. 5.
Figure 8B:
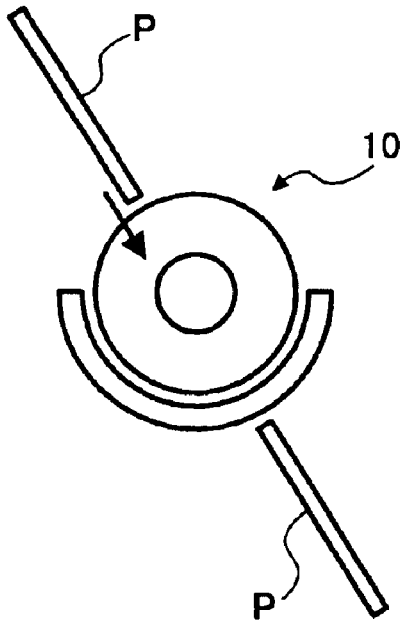

As shown in FIG. 8A, an opening 10C is formed in the bottom of the toner bottle 10. As shown in FIG. 8B, if the opening 10C is formed in the side wall of the toner bottle 10, then it is apt to overlap a bottle support portion, depending on the position of the toner bottle 10. The opening 10 formed in the bottom is so positioned as not to interfere with the motor or the drive device 11 mentioned earlier.

Figure 9:
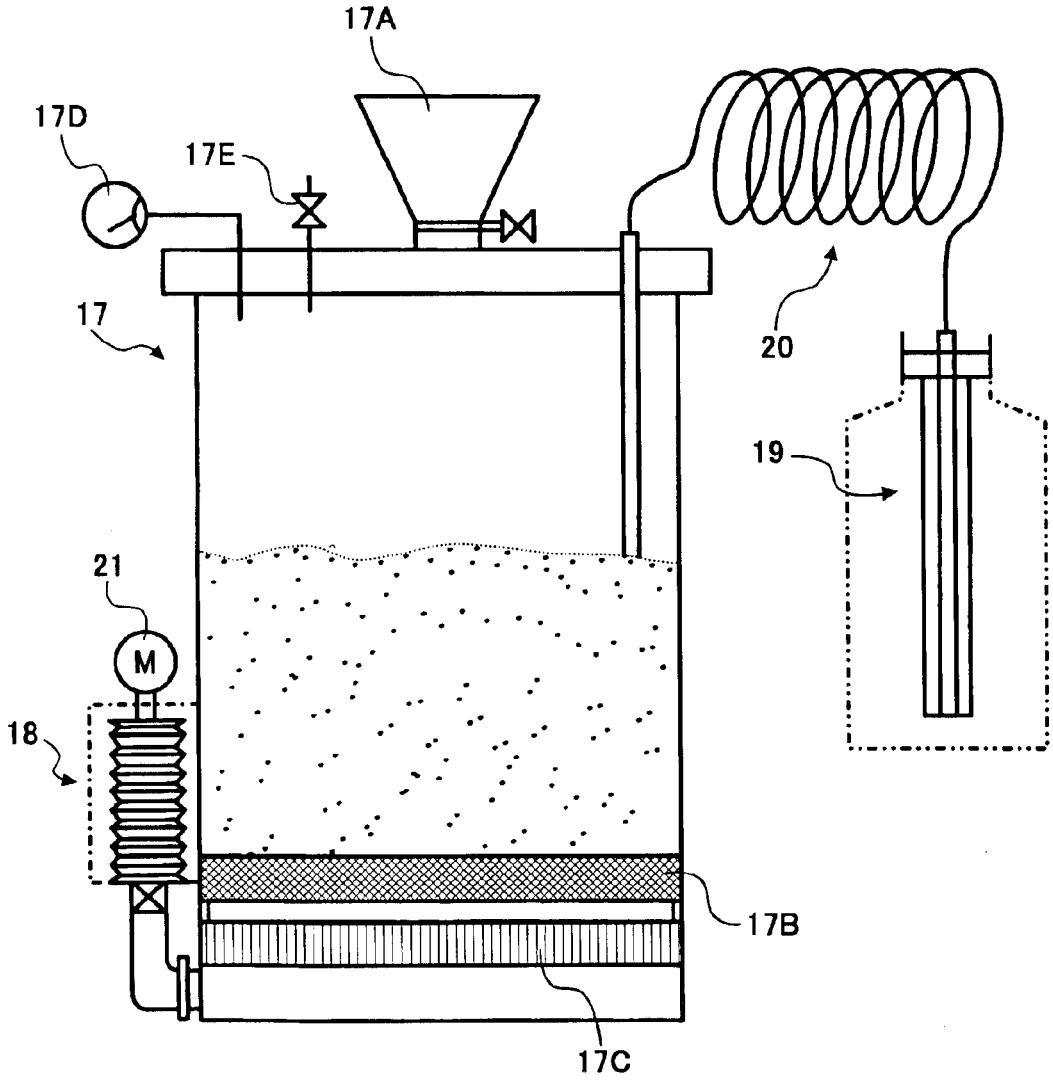
FIG. 9 shows means for feeding fresh toner to the toner replenishing section.
Figure 10:
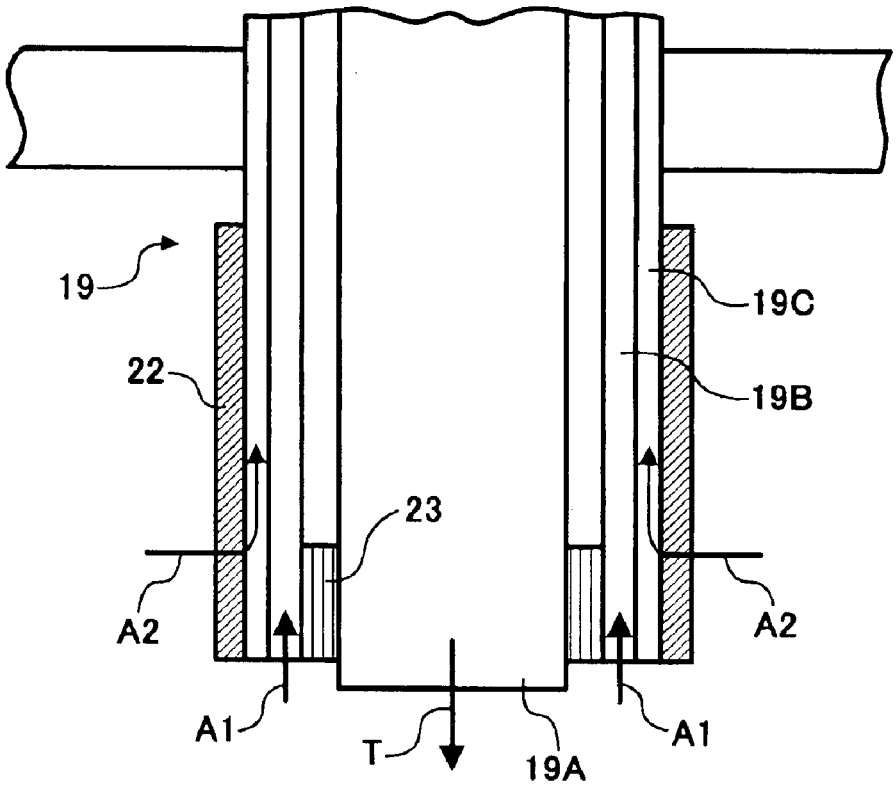
FIG. 10 is a view showing a specific configuration of a nozzle corresponding to a filling member included in the toner feeding means.

Reference will be made to FIGS. 9 and 10 for describing a toner feeding device including a nozzle that corresponds to the toner filling member. FIG. 9 shows a fluidizing device 17 serving as the toner feeding device and an arrangement for feeding fluidized toner from the fluidizing device 17 to the toner replenishing section, which is the toner hopper 4C or the toner bottle 10. In the illustrative embodiment, the toner has a grain size as small as about 10 $\mu$m by way of example.

The fluidizing device 17 includes a hermetically closed casing provided with a hopper 17A on its top. A compressor 18 sends air under pressure into the casing for fluidizing toner stored in the casing. A nozzle 19 introduces the toner flowing out of the casing into the toner replenishing section, which is represented by a bottle for convenience in FIG. 9. A piping 20 provides fluid communication between the casing and the nozzle 19.

The compressor 18 includes a pump driven by a motor 21, so that outside air is sucked into the compressor 18. A filter 17B allows compressed air to flow into the toner present in the casing while an air distributing member 17C evenly distributes air over the entire filter 17B. A pressure gauge 17D measures pressure inside the casing above the toner. A valve 17E exhausts the inside of the casing to thereby lower pressure inside the casing.

The nozzle 19 is to be inserted into any one of the ports 4C1 and 4C2, FIG. 2, and opening 10C, FIG. 8A, such that its tip enters the toner hopper 4C or the toner bottle 10, which constitutes the toner replenishing section. Specifically, as shown in FIG. 10, the nozzle 19 has a multiple-wall structure including a toner passage 19A, an inner air suction passage 19B, and an outer air suction passage 19C. The toner passage 19A allows toner T to flow therethrough under the pressure inside the casing fluidizing device 17. The inner air suction passage 19B surrounds the toner passage 19A and sucks air A1 out of the toner replenishing section via the open end of the nozzle 19. The outer air suction passage 19C surrounds the inner air suction passage 19B and sucks air A2 around the nozzle other than air adjacent the open end of the nozzle 19.

A mesh 22 surrounds the outer air suction passage 19 while a mesh 23 intervenes between the inner air suction passage 19B and the toner passage 19A.

As shown in FIG. 9, the fluidizing device 17 and nozzle 19 are communicated to each other by the piping 20, so that the toner is fed from the fluidizing device 17 to the toner replenishing section, i.e., the toner hopper 4C or the toner bottle 10, by the following procedure. After toner has been introduced in the casing via the hopper 17A with the valve 17E being held in a closed position, the motor 21 is energized to drive the pump of the compressor 18 so as to send compressed air into the casing while evenly distributing it. As a result, pressure inside the casing rises and causes the toner to flow out of the casing to the nozzle 19 via the piping 20. At this instant, air inside the nozzle 19 is exhausted via the outer air suction path 19C due to the pressure acting in the inside of the nozzle 19. Consequently, the inside of the toner hopper 4C or the toner bottle 10 is depressurized, causing the toner to be refilled in the toner hopper 4C or the toner bottle 10.

The fluidizing device 17 is portable and can be transported to a place where the image forming apparatus is located.

Figure 11:
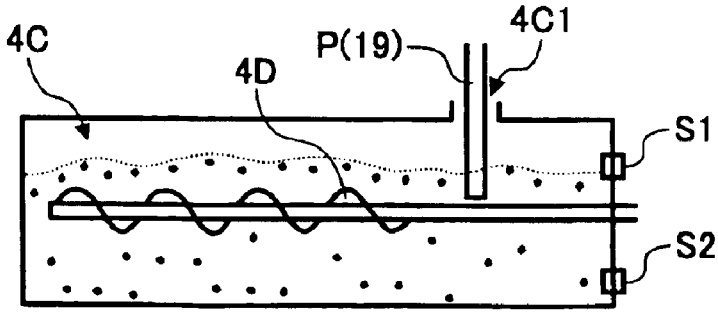
FIG. 11 shows a specific configuration of sensing mans responsive to the amount of toner present in the toner replenishing section.

Arrangements for sensing the amount of toner remaining in the toner replenishing portion and the full state of the toner replenishing portion are associated with each of the toner hopper 4C and toner bottle 10. Specifically, FIG. 11 shows such arrangements associated with the toner hopper 4C. As shown, a full sensor S1 and a residual amount sensor S2 are positioned inside the toner hopper 4C at an upper portion and a lower portion, respectively, with respect to the axis of the screw 4D. The output of the full sensor S1 is representative of the amount of toner being refilled in the toner hopper 4C and used to cause the fluidizing device 17 to stop operating. As for the residual amount sensor 32, when the amount of toner remaining in the toner hopper 4C decreases to a preselected amount, an alarm is output or the fluidizing device 17 is caused to start operating.

Figure 12:
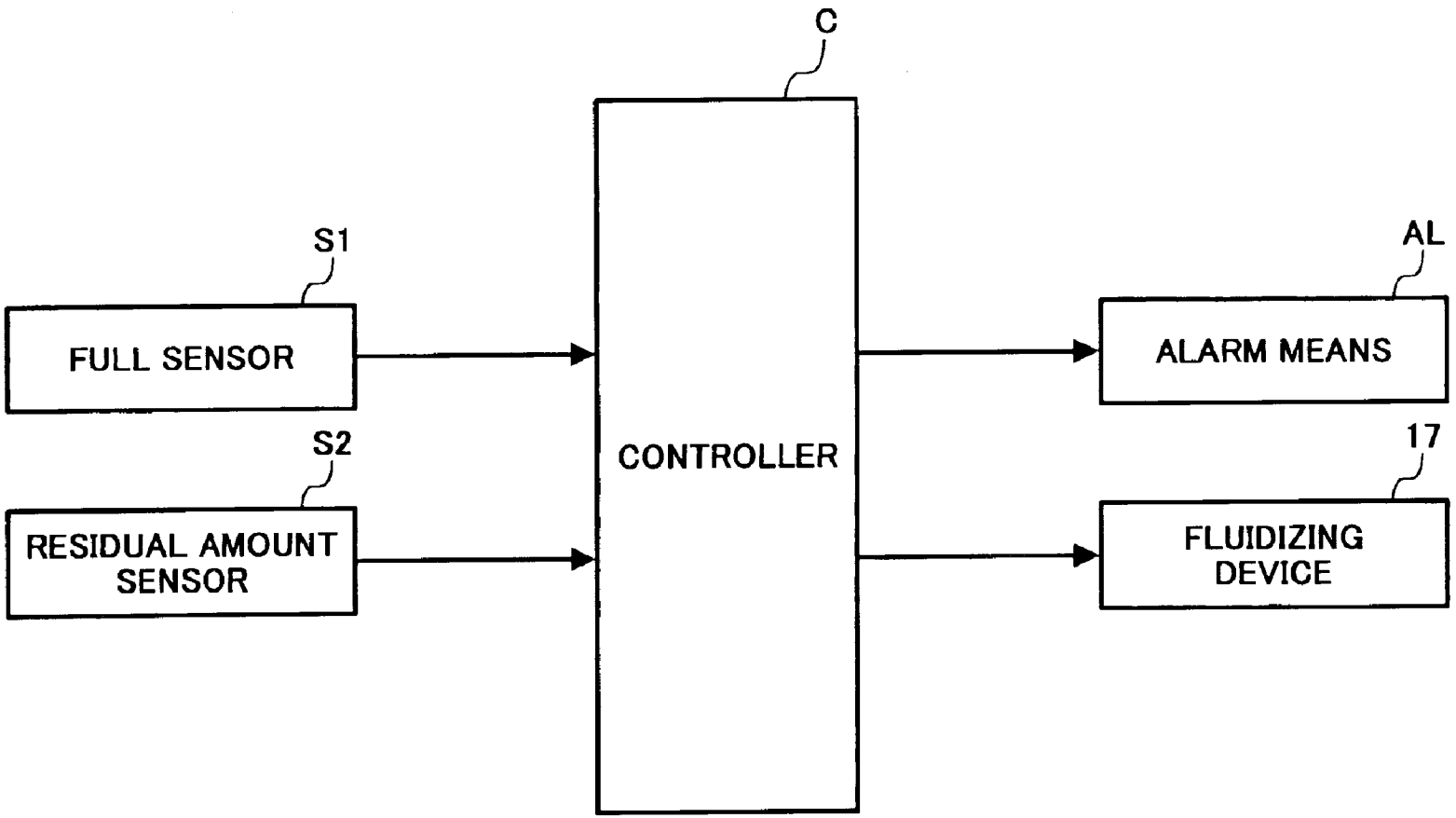
FIG. 12 is a schematic block diagram showing a control system including the sensing means.

FIG. 12 shows a control system associated with the sensor arrangements shown in FIG. 11. As shown, the control system includes a controller C to which the outputs of the full sensor S1 and residual amount sensor S2 are input via an I/O (Input/Output) interface (not shown). An alarm device AL and the fluidizing device 17 are connected to the output side of the controller C. The controller C determines the amount of toner remaining in the toner replenishing section in accordance with the outputs of the sensors S1 and S2 and outputs an alarm message, as needed. Also, when the fluidizing device 17 is connected to the toner replenishing section beforehand, the controller C causes the fluidizing device 17 to start operating while outputting the alarm message. The operation of the controller C will be described more specifically with reference to FIG. 13.

Figure 13:
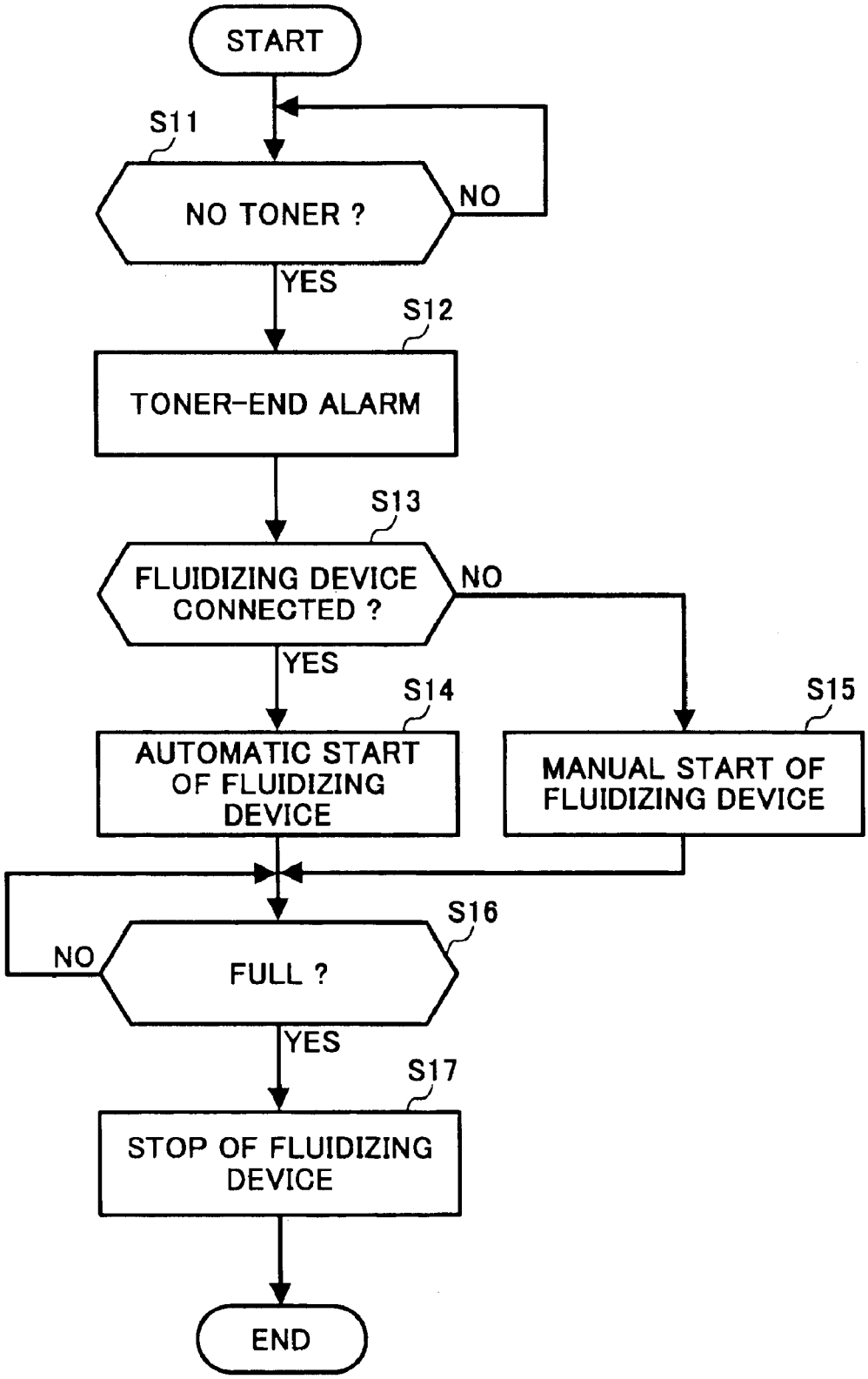
FIGS. 13 and 14 are flowcharts each demonstrating a particular specific operation of the control system of FIG. 12.

As shown in FIG. 13, the controller C determines whether or not the amount of toner remaining in the toner hopper 4C or the toner bottle 10 is short or substantially zero in accordance with the output of the sensor S2 (step S11). If the answer of the step S11 is positive (YES), then the controller C outputs a toner-end alarm (step S12). After the step S12, the controller C determines whether or not the fluidizing device 17 is connected to the toner replenishing section (step S13). If the answer of the step S13 is YES, then the controller C automatically causes the fluidizing device 17 to start operating (step S14). If the answer of the step S13 is negative (NO), then the controller C urges the user or a service person to start the fluidizing device 17 by hand at, e.g., an office or a home (step S15).

More specifically, to refill toner in the toner replenishing section, the nozzle or toner refilling member 19 is inserted into any one of the ports 4C1 and 4C2 and opening 10C formed in the toner replenishing section. In the port 4C1 or 4C2 or the opening 10C (filling portion) in which the nozzle 19 is inserted, the valve structure is forced to open and admit the toner fed from the fluidizing device 17 into the toner replenishing section. The controller C, monitoring the output of the full sensor S1, determining whether or not the toner replenishing section has been filled up with the toner (step S16). If the answer of the step S16 is YES, then the controller C causes the fluidizing device 17 to stop operating (step S17).

In the illustrative embodiment, the toner feeding device including the portable fluidizing device 17 and nozzle 19 allows a person to easily replenish fresh toner to the toner replenishing section simply by inserting the nozzle 19. This makes it needless to dismount the toner hopper 4C or the toner bottle 10 from the developing device 4 and then collect it.

The controller C shown in FIG. 12 may be configured to determine the amount of toner remaining in the toner replenishing section by counting the duration of replenishment being effected from the toner replenishing section to the developing section, thereby estimating the amount of consumption in the toner replenishing portion beforehand. In such a case, the controller C estimates the time when the toner in the toner replenishing portion will become short, and replenishes fresh toner from the fluidizing device 17 before the estimated time. With this alternative scheme, it is possible to feed fresh toner before the timing based on the sensor output representative of toner remaining in the toner replenishing section and therefore to free the toner replenishing section from a short-toner condition. Such an alternative procedure will be described more specifically with reference to FIG. 14.

Figure 14:
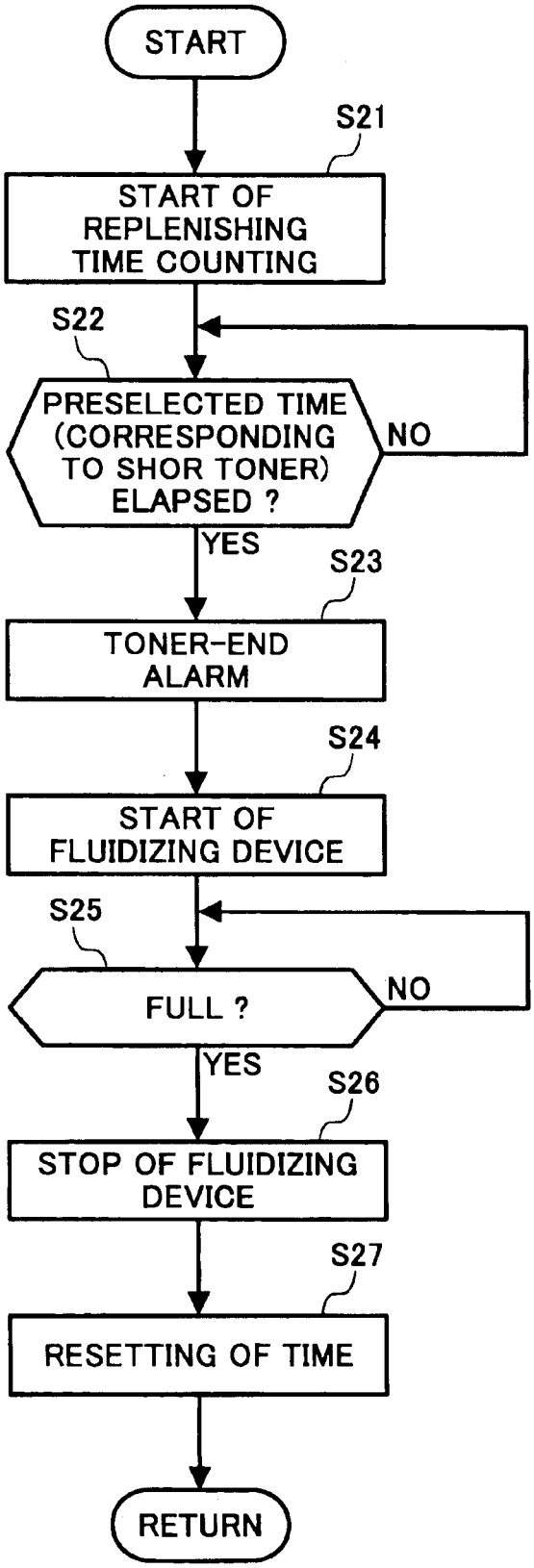

As shown in FIG. 14, on the start of an image forming operation, the controller C starts counting the duration of toner replenishment (step S21) and then determines whether or not the duration has reached a preselected period of time in which the toner becomes short (step S22). If the answer of the step S22 is YES, then the controller C outputs a toner-end alarm (step S23) and causes the fluidizing device 17 to start feeding fresh toner to the toner replenishing section (step S24). Subsequently, the controller C checks the output of the full sensor S1 to see if the toner replenishing section has been filled up with the fresh toner (step S25). If the answer of the step S25 is YES, then the controller C causes the fluidizing device 17 to stop operating (step S26). Thereafter, the controller C resets the time counted (step S27) and returns to the step S21.

Figure 15:
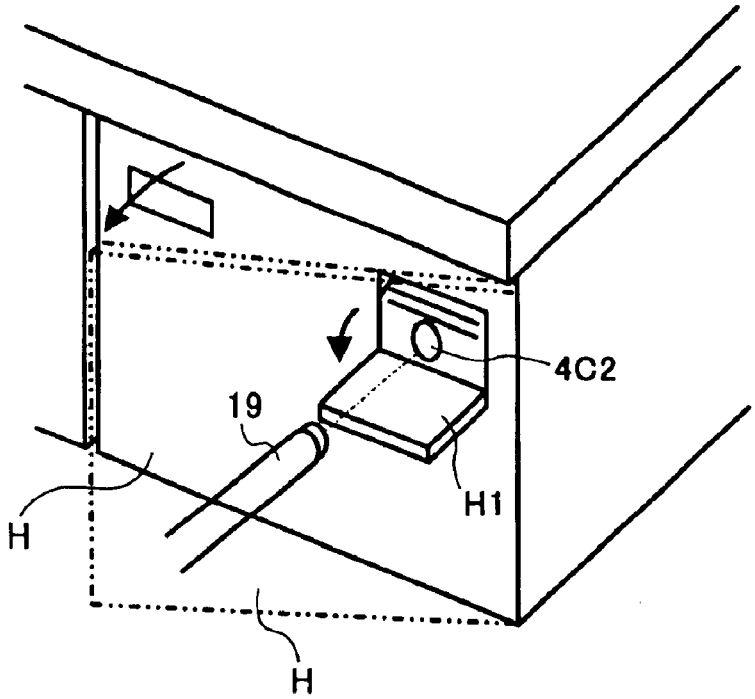
FIG. 15 is an external view showing part of a modification of the illustrative embodiment.

FIG. 15 shows a modified form of the illustrative embodiment. As shown, an image forming apparatus accommodating the developing device includes a casing including a wall H. The wall H is openable at the time of, e.g., maintenance, as indicated by a dash-and-dots line in FIG. 15, A switch, not shown, is mounted on the casing to face the wall H. When the wall H is opened, the apparatus is caused to stop operating in response to the output of the switch. Part H1 of the wall H is implemented as a separate openable portion H1. The port or refilling portion 4C2 of the developing device 4 faces the portion H1 of the wall H. In this configuration, when the portion H1 is opened, the port 4C2 of the toner replenishing portion is accessible for refilling it with fresh toner fed from the fluidizing device 17 via the nozzle 19.

When only the portion H1 of the wall H is opened, the switch responsive to the opening of the entire wall H does not operate. Therefore, fresh toner can be refilled in the toner replenishing section without the operation of the apparatus being interrupted.

Another modification of the illustrative embodiment will be described with reference to FIG. 16. Briefly, in the modification to be described, the fluidizing device 17 is not connected to the toner replenishing section on the basis of the amount of toner remaining in the toner replenishing portion, but is connected to the toner replenishing section beforehand. In this case, the fluidizing device 17 is implemented as a large-capacity tank situated outside of the image forming apparatus.

Figure 16:
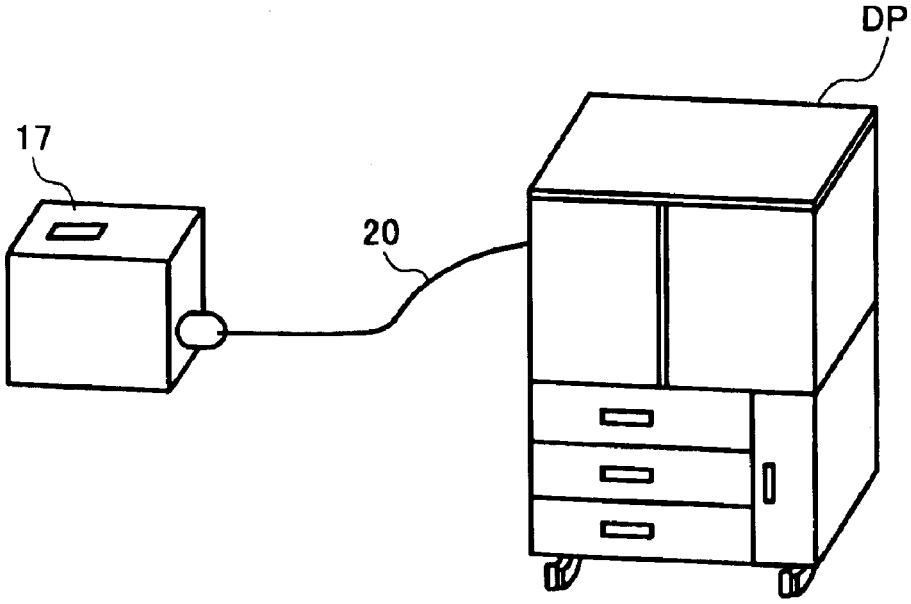
FIGS. 16, 17 and 18 each demonstrate a specific configuration for feeding fresh toner available with the illustrative embodiment.

More specifically, as shown in FIG. 16, the fluidizing device 17 is provided with a size larger than the portable size and located in the vicinity of an image forming apparatus DP. The nozzle 19, not shown, of the piping 20 is inserted beforehand in the refilling portion of the toner replenishing section included in the developing device, which is accommodated in the apparatus DP. The fluidizing device 17 is operated in accordance with the amount of toner remaining in the toner replenishing section, i.e., toner hopper 4C or the toner bottle 10, so that fresh toner is automatically fed to the toner replenishing section. Alternatively, the user may cause the fluidizing device 17 to start operating in response to the toner-end alarm derived from the output of the residual amount sensor S2, FIG. 11. In any case, the fluidizing device 17 is automatically caused to stop operating in accordance with the output of the full sensor S1, FIG. 11.

Figure 17:
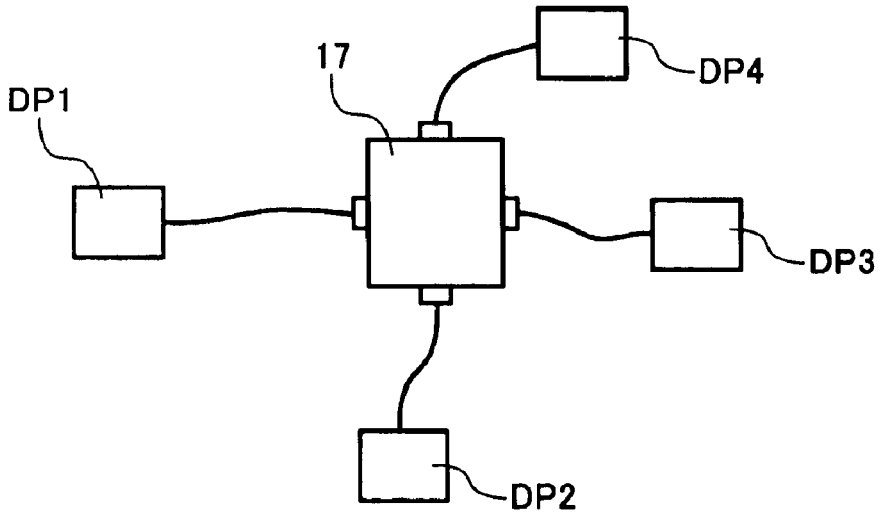
Figure 18:
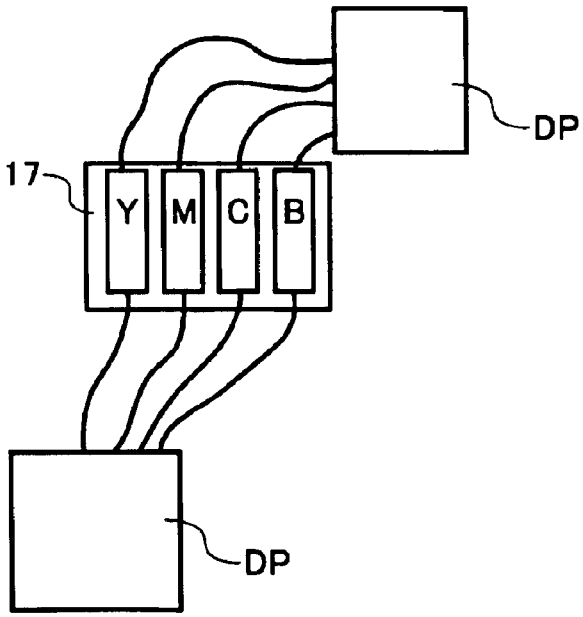

As shown in FIG. 17, the fluidizing device may be connected to a plurality of image forming apparatuses DP1 through DP4 for feeding fresh toner of a single color thereto. Further, as shown in FIG. 18, the fluidizing device 17 may store toners of different colors Y (yellow), M (magenta), C (cyan) and B (black) and feed them to image forming apparatuses DP.

The illustrative embodiment and modifications thereof have various advantages, as enumerated below.

(1) When the toner replenishing section included in the developing device is short of toner, it can be replenished with fresh toner from the outside without being replaced or collected. Stated another way, it is possible to implement a semi-permanent toner replenishing structure without giving consideration to the frequency of replacement. In addition, the toner refilling portion configured to receive the toner from the outside is provided with a valve structure, preventing toner from leaking to the outside of the toner replenishing section.

(2) The amount of remaining toner and full state can be confirmed, so that the semi-permanent toner replenishing structure obviates short or excessive replenishment.

(3) Fresh toner can be automatically replenished.

(4) Fresh toner can be refilled in the toner replenishing section without bringing about alarm processing, e.g., the interruption of image formation.

Second Embodiment

Figure 19:
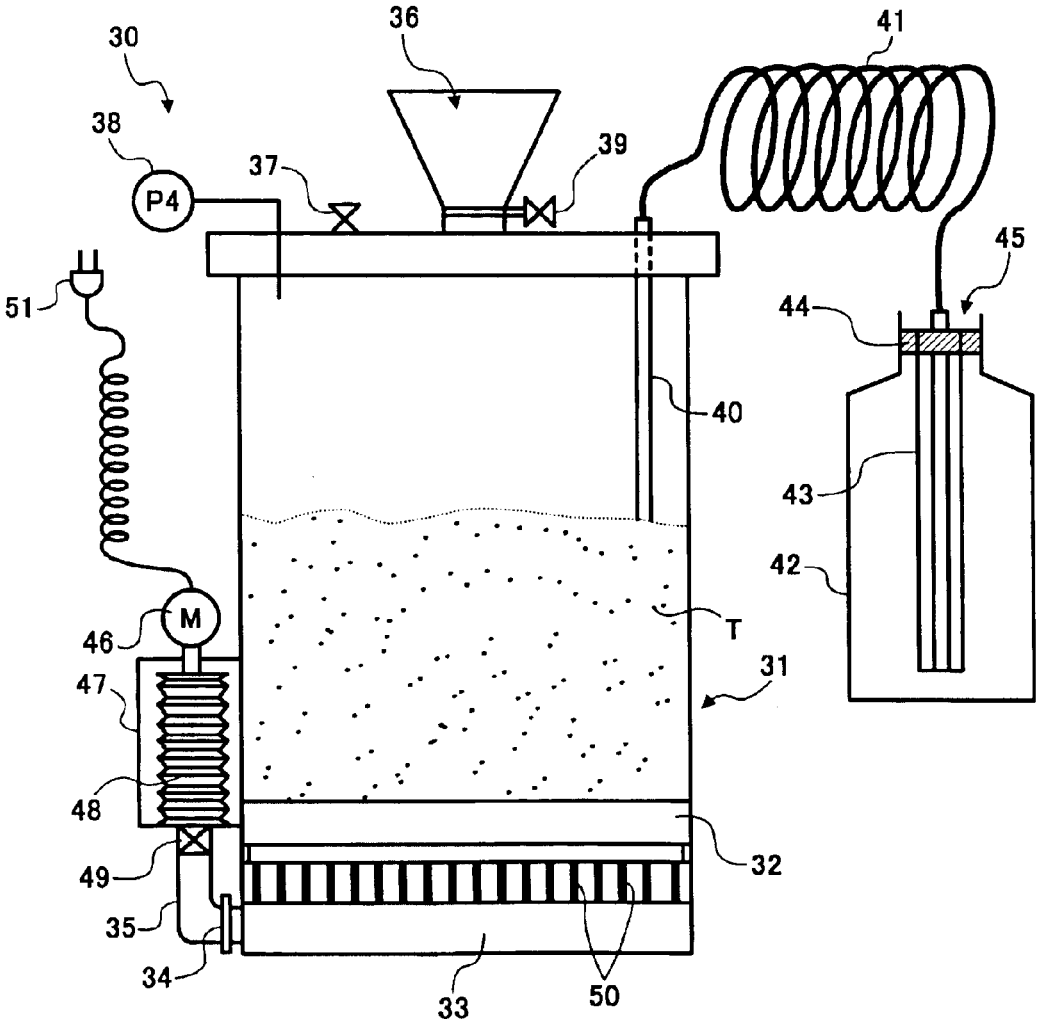
FIG. 19 shows a second embodiment of the toner refilling device in accordance with the present invention.

Referring to FIG. 19, an alternative embodiment of the present invention is shown and also provided with a portable configuration. As shown, the toner refilling device, generally 30, includes a toner fluidizing device 31 which is usually hermetically closed. A porous plate 32 is removably mounted on the bottom portion of the fluidizing device 31 via a flange, not shown, for causing toner to flow. The porous plate 32 is implemented as, e.g., a sintered metal plate, a baked resin plate or a mesh screen with a small mesh. An air header 33 is positioned beneath the porous plate 32 while a pipe 35 is removably fitted in the air header 33 and provided with a control valve 34.

A hopper 36 is positioned on the top of the fluidizing device 31 for allowing fresh toner T to be introduced into the fluidizing device 31. A valve 37 is operated to depressurize the inside of the fluidizing device 31. A pressure gauge 38 is responsive to pressure inside the fluidizing device 31. A flow rate control valve 39 is associated with the hopper 36 for effecting fine pressure control.

Fresh toner T introduced in the fluidizing device 31 is refilled in a toner container or toner replenishing section 42 via an outlet tube 40, a piping 41, and a nozzle 43. A porous plate 45 with a soft packing 44 fitted thereon is affixed to the root portion of the nozzle 43. The nozzle 43 is inserted into the mouth of the toner container 42 to be refilled with the toner T. When the nozzle 43 is inserted into the mouth of the toner container 42, the porous plate 45 with the soft packing 44 stops the mouth.

In operation, after the valve 37 has been opened, fresh toner T is introduced into the fluidizing device 31 via the hopper 36. Subsequently, a motor 46 is energized to cause a pump 48, which is removably mounted on a frame 47, to expand and contract. As a result, the fluidizing device 31 is caused to vibrate via the frame 47, causing the toner T present in the device 31 to vibrate. At the same time, the pump 48 sends compressed air into the air header 33 via a check valve 49, the conduit 35, and valve 34. Compressed air introduced into the air header 33 is substantially evenly scattered into the toner T via distributing plates 50 and the porous plate 32. This, coupled with the vibration, sufficiently fluidizes the toner T.

Subsequently, after the nozzle 43 has been inserted into the mouth of the toner container 42, the valve 37 is closed. As a result, the toner T is refilled in the toner container 42 via the outlet tube 40, piping 41 and nozzle 43 due to the pressure of compressed air being sent into the fluidizing device 31.

The toner refilling device 30 is provided with a light weight, small size configuration, so that it can be carried to any desired position. Further, anyone can easily operate the toner refilling device 30 simply by inserting a power supply plug 51 associated with the motor 46 into a receptacle mounted on a printer or similar image forming apparatus. Therefore, with the toner refilling device 30, a service person can refill fresh toner in the toner container 42 at the user's station. This makes it needless for the service person to collect the toner container 42.

Figure 20:
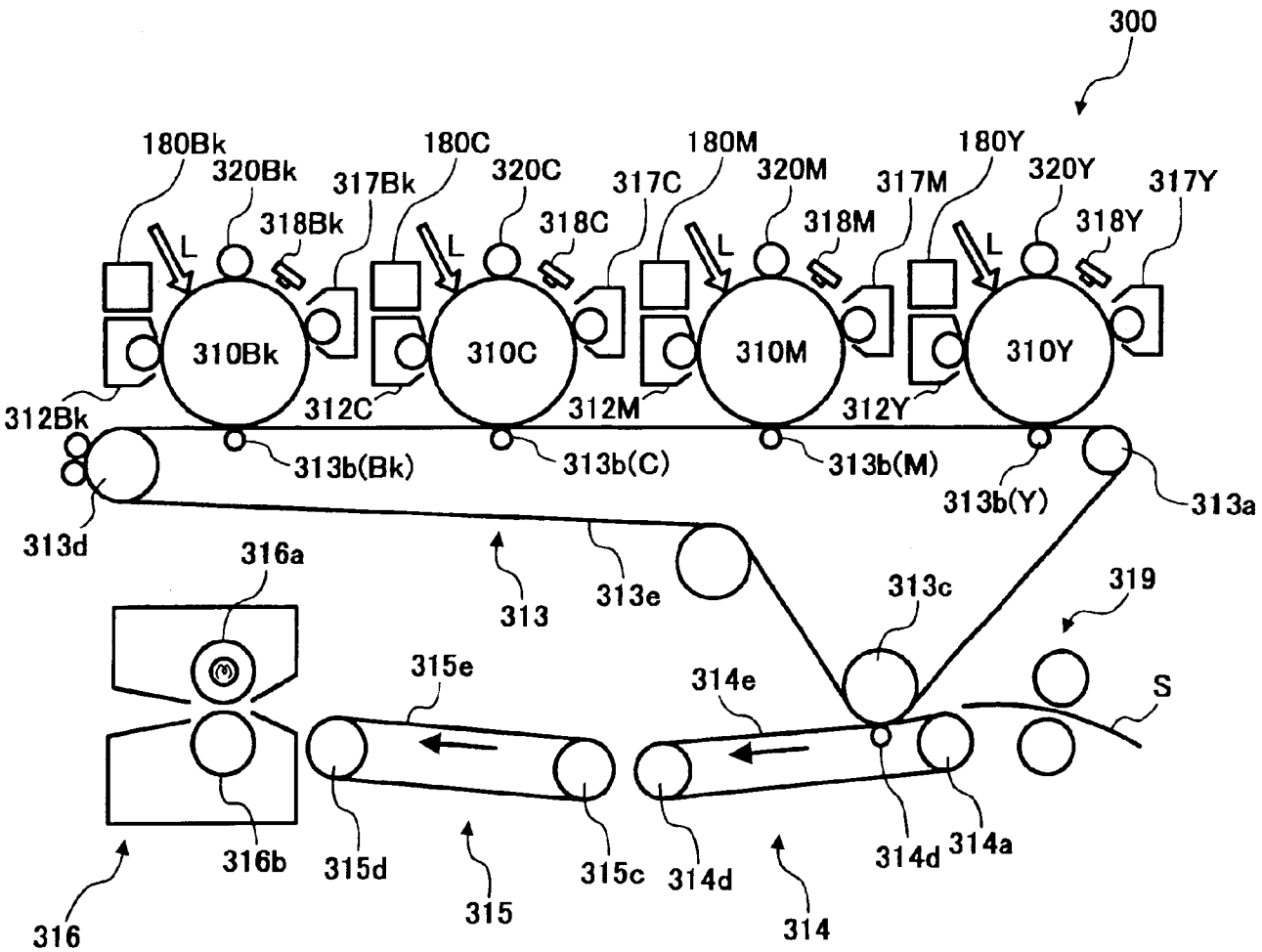
FIG. 20 shows a specific configuration of an image forming apparatus to which the second invention is applied.

Hereinafter will be described a specific configuration of an image forming apparatus including the toner container 42. As shown in FIG. 20, the image forming apparatus is implemented as a tandem printer 300 including four image forming devices configured to form a toner image with Y, M, C and Bk toners. Because the four image forming devices are identical in configuration except for the color, their structural elements are simply distinguished by suffixes Y, M, C and Bk.

Photoconductive drums or image carriers 310Y, 310M, 310C and 310Bk each are rotatable counterclockwise, as viewed in FIG. 20. Charge rollers 320Y, 320N, 320C and 320Bk uniformly charge the surfaces of the drums 310Y, 310M, 310C and 310Bk, respectively. Laser beams L issuing from an optical writing unit, not shown, each scan the charged surface of particular one of the drums 310Y through 310Bk in accordance with image data to thereby form a latent image. The image data is any one of Y, M, C and Bk image data derived from a full-color image. As a result, Y, M, C and Bk latent images are formed on the drums 310Y, 310M, 310C and 310Bk, respectively. Developing devices 312Y, 312M, 312C and 312Bk, which are respectively arranged around the drums 310Y, 310M, 310C and 310Bk, sequentially develop the Y, M, C and Bk latent images to thereby form Y, M, C and Bk toner images on the drums.

The drums 310Y through 310Bk are held in contact with an intermediate image transfer belt (simply belt hereinafter) 313*e* included in an intermediate image transfer unit 313. The belt 313*e* is passed over a roller 313*a*, bias rollers 313*b* (Y, M, C and Bk) for primary image transfer, a backup roller 313*c* for secondary image transfer and a drive roller 313*d* and movable clockwise, as viewed in FIG. 20. The Y through Bk toner images formed on the drums 310Y through 310Bk, respectively, each enter a nip between the associated drum and the belt 313*e*. Consequently, the Y through Bk toner images are transferred from the drums 310Y through 310Bk to the belt 313*e* one above the other by the bias rollers 313*b* (Y through Bk), completing a full-color image on the belt 313*e*. Let this image transfer be referred to as primary image transfer.

After the primary image transfer, cleaning units 317Y, 317M, 317C and 317Bk remove toner left on the drums 310Y, 310M, 310C and 317Bk, respectively. Subsequently, quenching lamps 318Y, 318M, 318C and 318Bk discharge the surfaces of the drums 310Y, 310M, 310C and 310Bk, respectively.

A first sheet conveying unit 314 is positioned below the intermediate image transfer unit 313 while a second sheet conveying unit 315 and a fixing unit 316 are positioned at the left-hand side of the conveying unit 314, as viewed in FIG. 20. The first sheet conveying unit 314 includes a belt 314*e* passed over a drive roller 314*d*, a driven roller 314*a* and a bias roller 314*d* and movable counterclockwise, as viewed in FIG. 20. A moving device, not shown, selectively moves the first sheet conveying unit 314 upward or downward. More specifically, before a toner image of a single color or a composite toner image of two or three different colors carried on the belt 313*e* arrives at the position where the conveying unit 314 faces the bias roller 314*d*, the moving device retracts the conveying unit 314 to a position where the belt 313*e* does not contact the toner image. Subsequently, before the leading edge of a full-color toner image completed on the belt 313*e* arrives at the above position, the moving device moves the conveying unit 314 to the position where the belt 314*e* contacts the toner image, thereby forming a nip for secondary image transfer.

On the other hand, a registration roller pair 319 once stops a sheet S fed from a sheet cassette, not shown, and then conveys it toward the nip for secondary image transfer at such a timing that the leading edge of the sheet S meets the leading edge of the full-color image carried on the belt 313*e*. In this condition, the bias roller 314*d* transfers the full-color toner image from the belt 313*e* to the sheet S. Let this image transfer be referred to as secondary image transfer.

The belt 314*e* of the first sheet conveying unit 314 conveys the sheet S carrying the full-color toner image thereon to the second sheet conveying unit 315. A belt 315*e* is included in the second sheet conveying unit 315 and passed over a drive roller 315*d* and a driven roller 315*c* to move counterclockwise, as viewed in FIG. 20. The belt 315*e* conveys the sheet S handed over from the first sheet conveying unit 314 to the fixing unit 316. In the fixing unit 316, a heat roller 316*a* and a press roller 316*b* convey the sheet S via a nip formed therebetween. As a result, the toner image on the sheet S is fixed on the sheet S by heat and pressure The developing devices 312Y, 312M, 312C and 312Bk respectively include toner containers 180Y, 180M, 180C and 180Bk each storing toner of a particular color. Toner in each of the toner containers 180Y through 180Bk is replenished to the associated developing device in accordance with consumption ascribable to repeated development. When any one of the toner containers 180Y through 180Bk runs out of toner (toner end), a service person refills the empty toner container with fresh toner T by using the toner refilling device 30.

A problem with the image forming apparatus 300 including a plurality of toner containers is that a service person is apt to refill the empty toner container with the wrong toner different in color from the specified toner. Particularly, when a plurality of image forming apparatuses 300 are situated at the user's station, a service person may collectively deal with all of the image forming apparatuses 300 alone. In such a case, the image forming apparatuses 300 are apt to differ from each other as to the kind of toner T and the amount of toner T to be refilled. This makes the above problem more serious.

Figure 21:
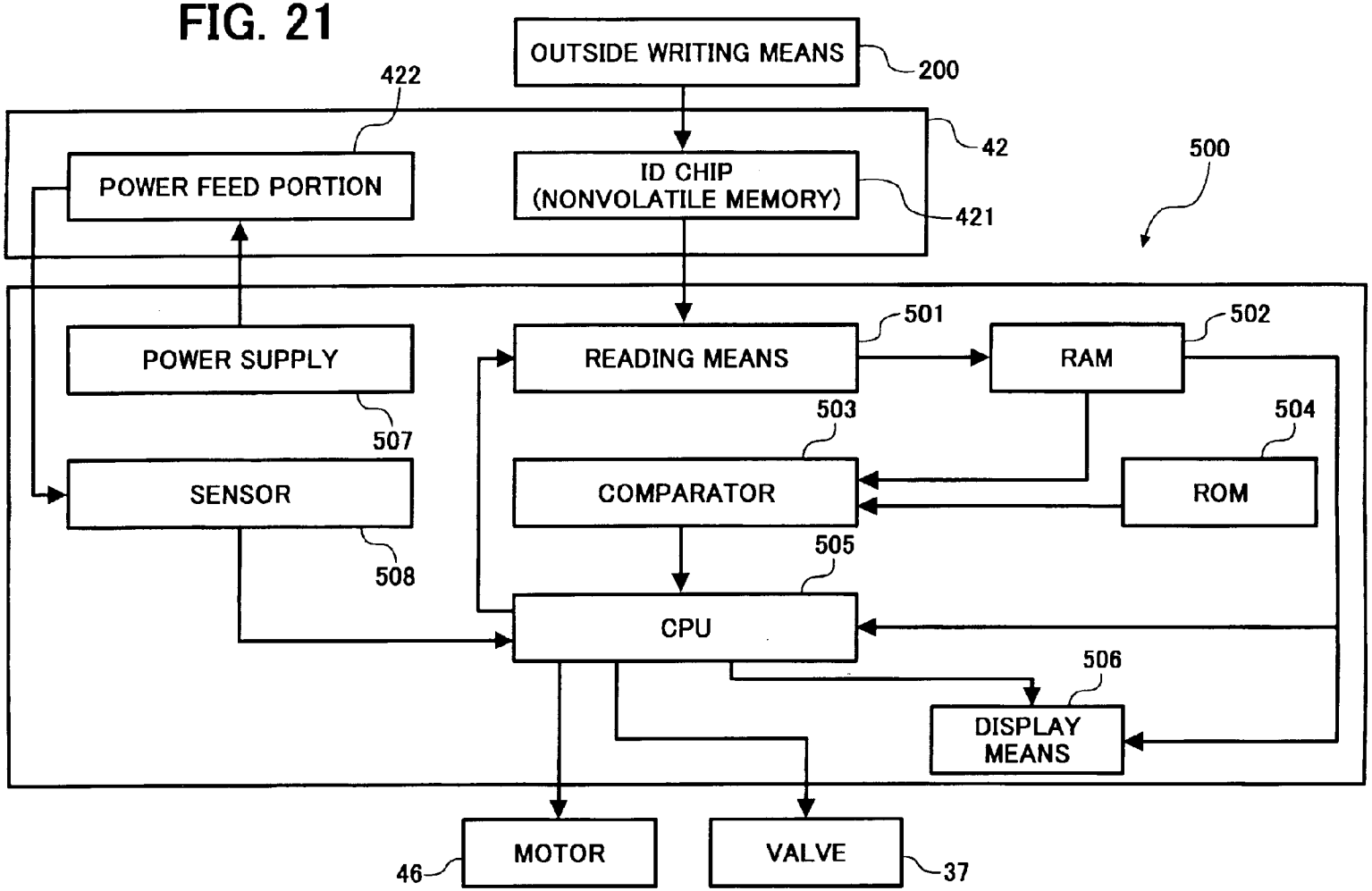
FIG. 21 is a schematic block diagram showing a control system included in a first example of the second embodiment.

FIG. 21 shows a control system 500 configured to solve the problem stated above. The toner container 42 may be implemented by any one of, e.g., a toner cartridge, a toner bottle, a toner hopper and a process cartridge so long as it can be refilled with fresh toner T. The toner container 42 is provided with a data storing medium storing data that authenticates toner stored in the toner container 42. The data storing medium may be implemented as a bar code or, as shown in FIG. 21, an ID (identification) chip 421, which is a smart chip or similar nonvolatile memory. When use is made of the ID chip 421, a preselected voltage is applied from a voltage feeding portion 422 to the ID chip 421. The voltage feeding portion 422 may be included in the toner container 4.2, as illustrated, or may be positioned outside of the toner container 42. The data particular to the toner stored in the toner container 42 is written to the ID chip 421 via outside writing means 200.

Figure 22:
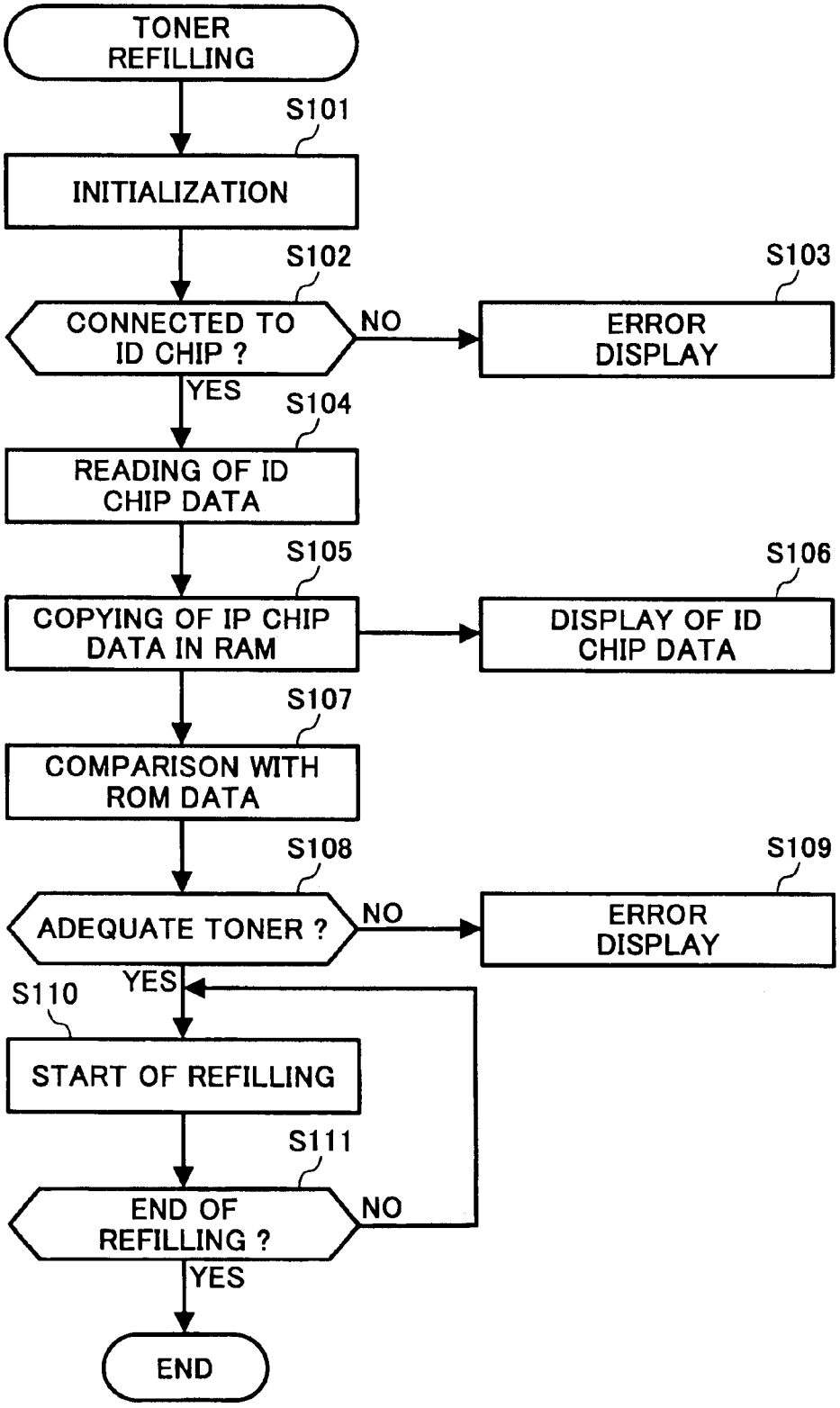
FIG. 22 is a flowchart demonstrating a specific operation of the first example.

A first example of the illustrative embodiment will be described with reference to FIGS. 21 and 22. As shown in FIG. 21, the control system 500 implementing the first example includes reading means 501 for reading the data out of the IC chip 421 before the refilling of fresh toner T in the toner container 42. The data read by the reading means 501 is written to a RAM (Random Access Memory) 502.

A comparator 503 compares the data written to the RAM 502 with data particular to toner to be newly refilled in the toner container 42, i.e., the toner T introduced into the toner refilling device 30. The data particular to the toner present in the toner refilling device 30 is stored in a ROM (Read Only Memory) 504 beforehand.

A CPU (Central Processing Unit) 505 plays the role of decision means for determining, based on the result of comparison output from the comparator 503, whether or not the toner T present in the toner refilling device 30 is the specified toner. Also, the CPU 505 plays the role of control means for controlling the motor 46 of the toner refilling device 30, valve 37 and so forth. Display means 506 displays the data stored in the RAM 502 and the result of decision output from the CPU 505.

A power supply or voltage source 507 feeds the preselected voltage to the voltage feeding portion 422. A sensor 508 determines whether or not the voltage is being applied to the voltage feeding portion 422. The control system 500 may be implemented as a unit that can be accommodated in the toner refilling device 30 or mounted to the toner refilling device 30.

A specific operation of the control system 500 of the first example will be described with reference to FIG. 22. As shown, on the start of a toner refilling procedure, initialization is effected (step S101). More specifically data particular to the toner T introduced in the toner refilling device 30 is written to the ROM 504. Also, the nozzle 43 is connected to the toner container 42 while the power supply 507 of the control system 500 is connected to the power feeding portion 422 of the toner container 42.

Subsequently, the CPU 505 checks the output of the sensor 508 to see if the control system 500 is electrically connected to the ID chip 421 or not (step S102). If the answer of the step S102 is NO, then the CPU 505 causes an error message to appear on the display means 506. If the answer of the step S102 is YES, then the CPU 505 causes the reading means 501 to read the data stored in the IC chip 421 of the toner container 42 (ID chip information) (step S104). The data readout of the ID chip 421 is written to the RAM 502 (step S105) while being displayed on the display means 506 (step S106). The comparator 503 compares the data stored in the ROM 504 and the data read out of the ID chip 421 (step S107). The CPU 505 determines, based on the result of comparison, whether or not the toner T to be refilled in the toner container 42 is the specified toner (step S108).

If the answer of the step S108 is NO, then the CPU 505 causes an error message to appear on the display means 506 (step S109). At this time, the CPU 505 deenergizes the motor 46 and opens the valve 37. If the answer of the step S108 is YES, then the CPU 505 starts the operation for refilling the toner container 42 with the toner T (step S110). Subsequently, the CPU 505 determines whether or not the toner container 42 is filled up with the toner T (step S111). If the answer of the step S111 is YES, then the toner refilling procedure ends.

Figure 23:
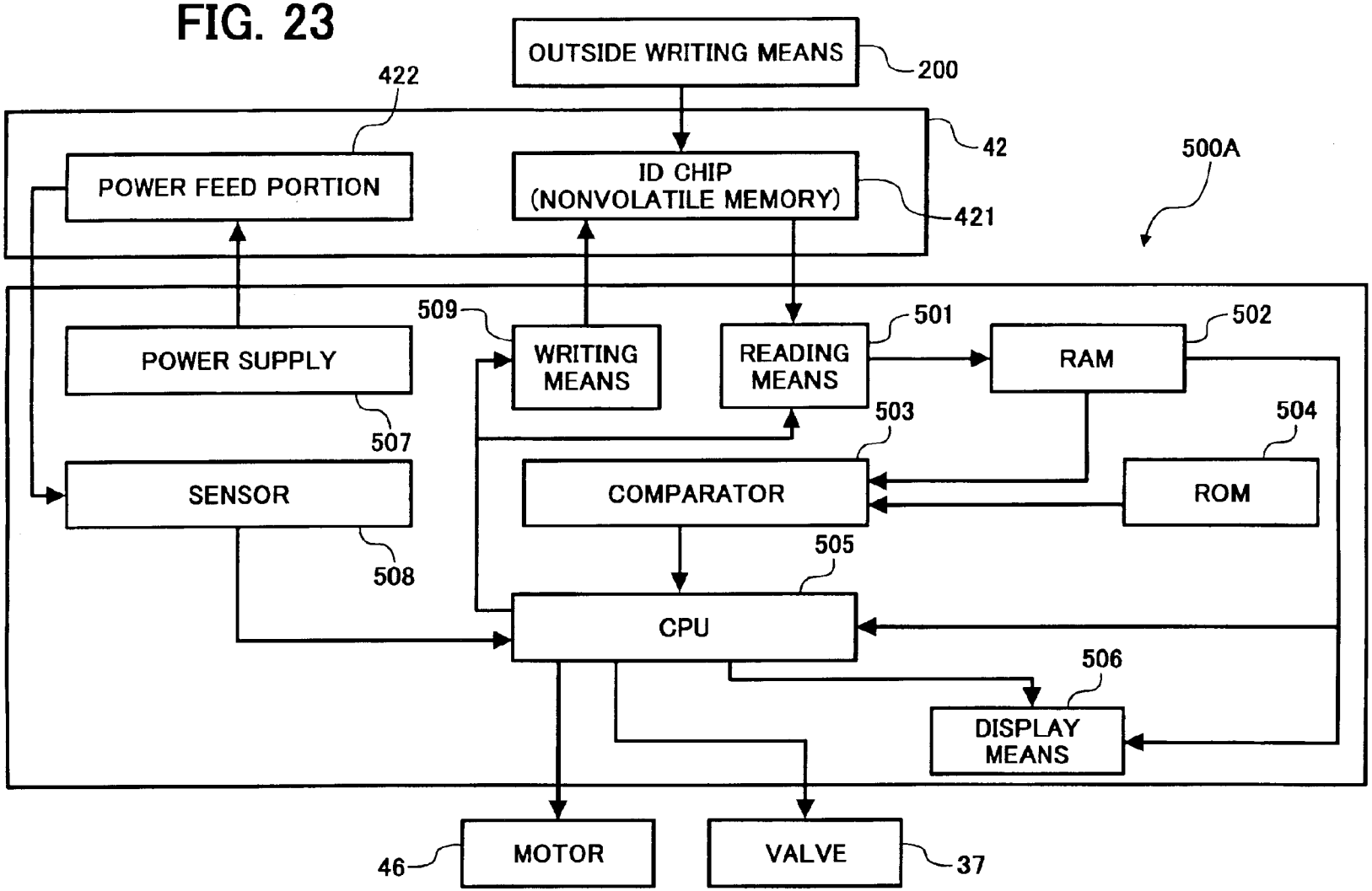
FIG. 23 is a schematic block diagram showing a control system included in a second example of the second embodiment.

Reference will be made to FIG. 23 for describing a second example of the illustrative embodiment. As shown, a control system 500A includes writing means 509 for writing data in the IC chip 421 in addition to the constituents of the control system 500. The writing means 509 is capable of writing not only the data particular to the toner T refilled in the toner container 42, but also information representative of the kind of the refilled toner T. The kind of the refilled toner includes the color, material, grain size and characteristics of the toner T, additives added to the toner T, and a lot number representative of the manufacturer and the date of production of the toner T. When the toner container 42 is to be refilled with the toner T, such data written to the ID chip 421 allows a service person to see the details of the toner refilled in the toner container 42 before and accurately determine whether or not the kind of the fresh toner T is adequate before operating the toner refilling device.

The writing device 509 is capable of additionally writing in the IC chip 421 data representative of the kind of the toner refilling device to be used. This data includes the performance and specification of the toner refilling device as well as a serial number identifying the manufacturer and the date of production of the device. Such data helps a service person determine whether or not the toner refilling device to use is adequate in the event of refilling or troubleshoot.

Further, the writing device 509 is capable of writing data representative of the date of refilling in the ID chip 421. This data allows a service person to see the time elapsed since the last refilling and therefore helps the service person correct image forming conditions at the time of maintenance of the image forming apparatus 300. Also, the writing device 509 is capable of writing data representative of the number of times of refilling effected in the past in the ID chip 421. This information allows a service person to accurately see the time for replacement of the toner container 42 on the basis of the frequency of past refilling and the life of the toner container 52 determined beforehand by experiments, thereby reducing time and labor for maintenance.

Moreover, the writing means 509 is capable of writing in the IC chip 421 data representative of the amount of toner T refilled in the toner container 42, showing a service person the amount of toner existed in the toner container 42 before. Also, by using the amount of toner and the number of prints output in the past, a service person can estimate the amount of toner remaining in the toner container 42 and the time when the toner container 42 will run out of toner. This prevents the amount of toner T to be refilled from being short or excessive. Further, with the estimated time when the toner container 42 will run out of timer, a service person can easily make out a maintenance schedule for the image forming apparatus 300. In addition, a service person, knowing the amount of remaining toner, can even meter the toner T and then refill it. Such metered refilling allows an adequate amount of toner to be refilled in a color image forming apparatus in which the amount of consumption differs from toner of one color to toner of another color, while making a charge for refilling clear.

When a service person again mounts the toner container 42 refilled with the toner T to the image forming apparatus, it is likely that the refilled toner T differs from the specified toner and adversely influences the operation of the image forming apparatus. For example, when a plurality of toner containers 42 are used in combination as in the image forming apparatus 300, toner of different colors are mixed together if the toner containers 42 are mixed up. Image forming apparatuses to be described hereinafter are capable of solving this problem.

The toner container 42 applied to image forming apparatuses to be described hereinafter may be implemented as any one of, e.g., a toner cartridge, a toner bottle, a toner hopper, and a process cartridge. Also, the toner container 42 may be affixed to the image forming apparatus or removably mounted to the same. The toner container 42 is easier to handle at the time of refilling when removable from the image formation apparatus than when affixed to the same.

Again, as shown in FIG. 23, the toner container 42 includes the ID chip 421 and voltage feeding portion 422. The outside writing means 200 shown in FIG. 24 or the writing means 509 shown in FIG. 23 writes beforehand the data particular to the toner T to be refilled in the toner container 42 in the ID chip 421. Each image forming apparatus to be described hereinafter may have any desired configuration, e.g., the tandem configuration shown in FIG. 20 or a single-drum configuration.

Figure 24:
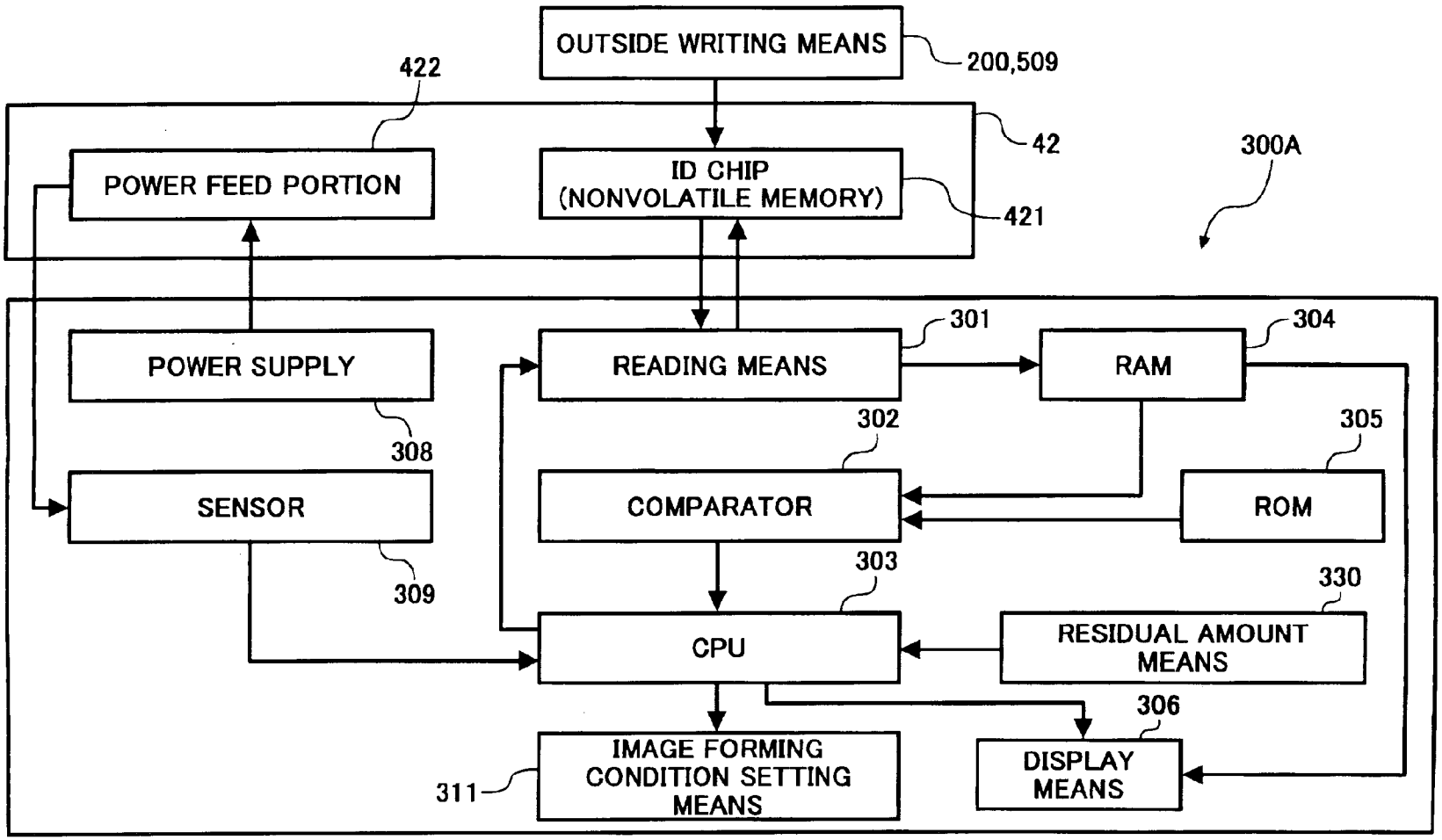
FIG. 24 is a schematic block diagram showing image formation control means included in an image forming apparatus to which the first example is applied.

As shown in FIG. 24, an image forming apparatus, which is a first example of the illustrative embodiment, includes an image formation control system 300A in addition to the constituents of the image forming apparatus 300, FIG. 20. The image formation control system 300A includes reading means 301 for reading, before the toner refilled in the toner container 42 is used, the data written to the ID chip 421 of the toner container 42 and particular to the toner. The data read out of the ID chip 421 is written to a RAM 304.

A comparator 302 compares the data stored in the RAM 502 with specified toner data stored in a ROM 504 beforehand and used to authenticate the toner to be fed from the toner container 42.

A CPU 303 plays the role of decision means for determining, based on the result of comparison output from the comparator 302, whether or not the toner T present in the toner container 42 is the specified toner applicable to the image forming apparatus. Also, the CPU 303 plays the role of control means for controlling image forming condition setting means 311 that determines the image forming conditions of the image forming apparatus. Further, the CPU 303 plays the role of control means for controlling the toner image forming means such that it uses the toner T only if the toner T is the specified toner.

Display means 306 displays the data stored in the RAM 304 and the result of decision output from the CPU 303.

A power supply or voltage source 308 feeds the preselected voltage to the voltage feeding portion 422. A sensor 309 determines whether or not the voltage is being applied to the voltage feeding portion 422. A residual amount sensor 330 is responsive to the amount of toner T refilled in the toner container 42.

Figure 25:
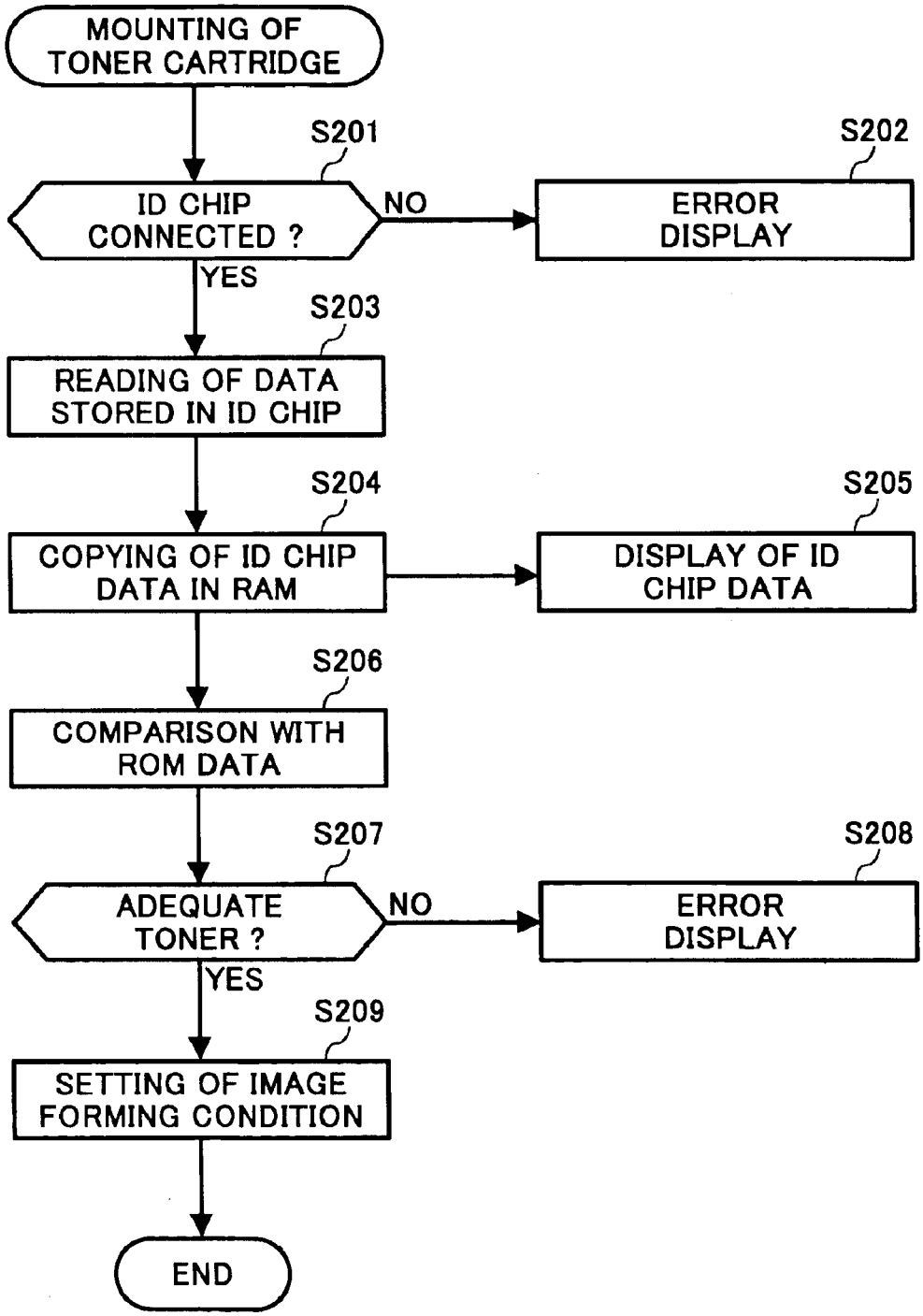
FIGS. 25 through 30 are flowcharts respectively showing specific operations particular to the second embodiment.

A specific operation to be executed by the image formation control system 300A when the toner container 42 is mounted to the image forming apparatus will be described with reference to FIG. 25. As shown, when the toner container 42 is mounted to the image forming apparatus, the CPU 303 checks the output of the sensor 309 to see if the power supply 308 of the image formation control system 300A is electrically connected to the ID chip 421 or not (step S201). If the answer of the step S201 is NO, then the CPU 303 causes an error message to appear on the display means 306. If the answer of the step S201 is YES, then the CPU 303 causes the reading means 301 to read the data stored in the IC chip 421 of the toner container 42 (ID chip information) (step S203). The data read out of the ID chip 421 is written to the RAM 304 (step S204) while being displayed on the display means 306 (step S205). The comparator 302 compares the specified toner data stored in the ROM 305 and the data read out of the ID chip 421 (step S206). The CPU 303 determines, based on the result of comparison, whether or not the toner T refilled in the toner container 42 is the specified toner (step S207).

If the answer of the step S207 is NO, then the CPU 303 causes an error message to appear on the display means 306 (step S208). At this time, the CPU 303 inhibits the image forming apparatus from operating. If the answer of the step S207 is YES, then the CPU 303 starts the replenishment of the toner T from the toner container 42 to the developing device. Subsequently, the image forming condition setting means 311 adjusts various image forming conditions including process conditions and the duration of toner agitation in accordance with the data particular to the toner T (step S209). This is the end of the procedure executed after the mounting of the toner container 42 to the image forming apparatus.

An image forming apparatus representative of a second example of the illustrative embodiment is identical with the image forming apparatus of FIG. 24 except for the following. In the second example, the reading means 301 reads data representative of the kind of the toner T refilled in the toner container 42. This data is written to the ID chip 421 beforehand when the toner container 42 is refilled with the toner T. The kind of the toner T includes the color, grain size, material and characteristics of the toner T as well as additives added to the toner T and a lot number representative of the manufacturer and the date of production of the toner T.

Figure 26:
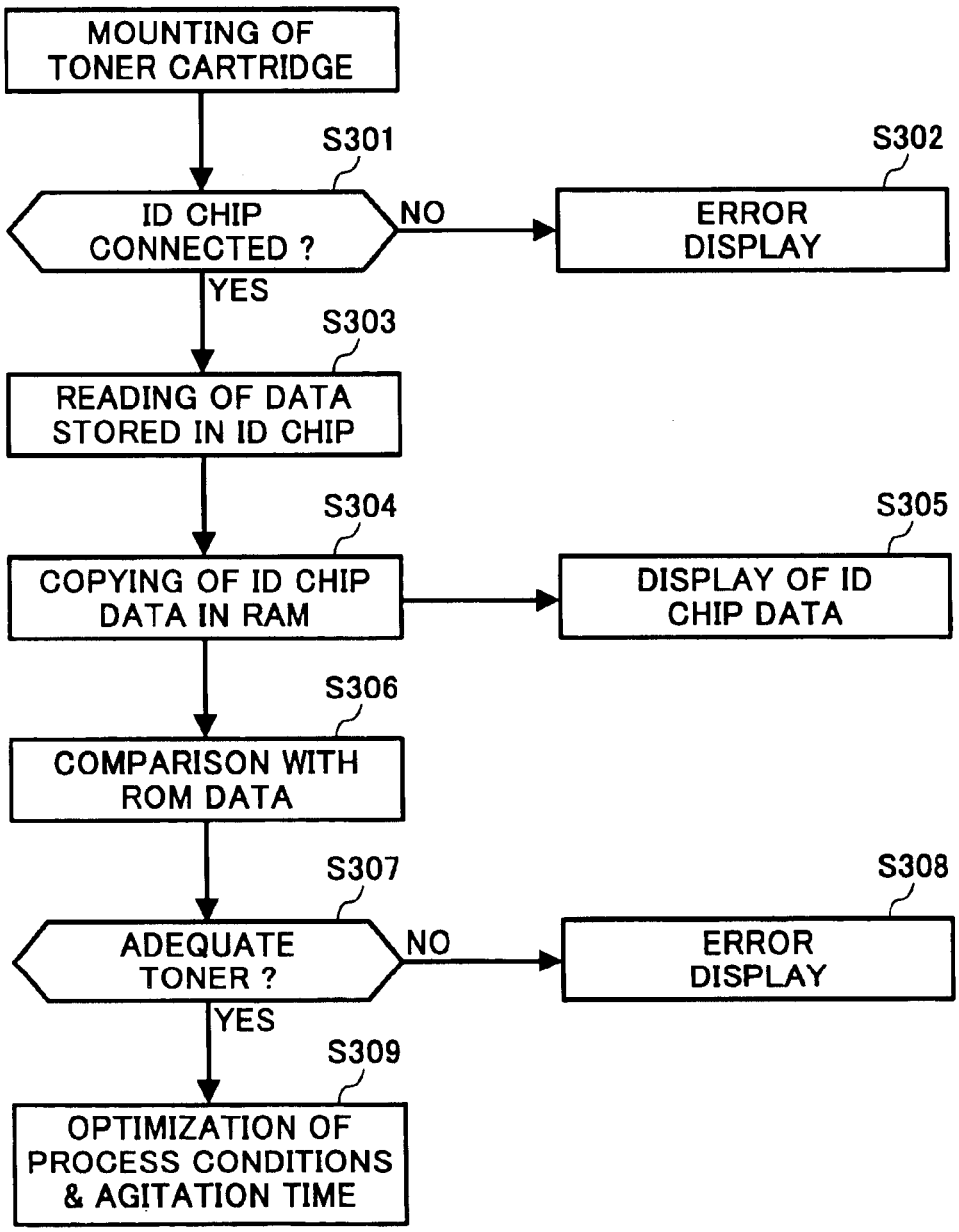

A specific operation to be executed by the second example when the toner container 42 is mounted to the image forming apparatus will be described with reference to FIG. 26. As shown, when the toner container 42 is mounted to the image forming apparatus, the CPU 303 checks the output of the sensor 309 to see if the power supply 308 of the image formation control system 300A is electrically connected to the ID chip 421 or not (step S301). If the answer of the step S301 is NO, then the CPU 303 causes an error message to appear on the display means 306 (step S302). If the answer of the step S301 is YES, then the CPU 303 causes the reading means 301 to read the data stored in the IC chip 421 of the toner container 42 (ID chip information) (step S303). The data readout of the ID chip 421 is written to the RAM 304 (step S304) while being displayed on the display means 306 (step S305). The comparator 302 compares the specified toner data stored in the ROM 305 and the data read out of the ID chip 421 (step S306). The CPU 303 determines, based on the result of comparison, whether or not the toner T refilled in the toner container 42 is the specified toner (step S307).

If the answer of the step S307 is NO, then the CPU 303 causes an error message to appear on the display means 306 (step S308) At this time, the CPU 303 inhibits the image forming apparatus from operating. If the answer of the step S307 is YES, then the CPU 303 starts the replenishment of the toner T from the toner container 42 to the developing device. Subsequently, the image forming condition setting means 311 adjusts various image forming conditions including process conditions and the duration of toner agitation in accordance with the data particular to the toner T (step S309). This is the end of the procedure executed after the mounting of the toner container 42 to the image forming apparatus.

An image forming apparatus representative of a third example of the illustrative embodiment is identical with the first or the second example except for the following. In the third example, the reading means 301 reads data representative of the kind of the toner refilling device used to refill the toner T. This data is written to the ID chip 421 beforehand when the toner container 42 is refilled with the toner T. The kind of the toner refilling device includes the performance and specification of the toner refilling device as well as a serial number representative of the manufacturer and the date of production of the toner refilling device.

Figure 27:
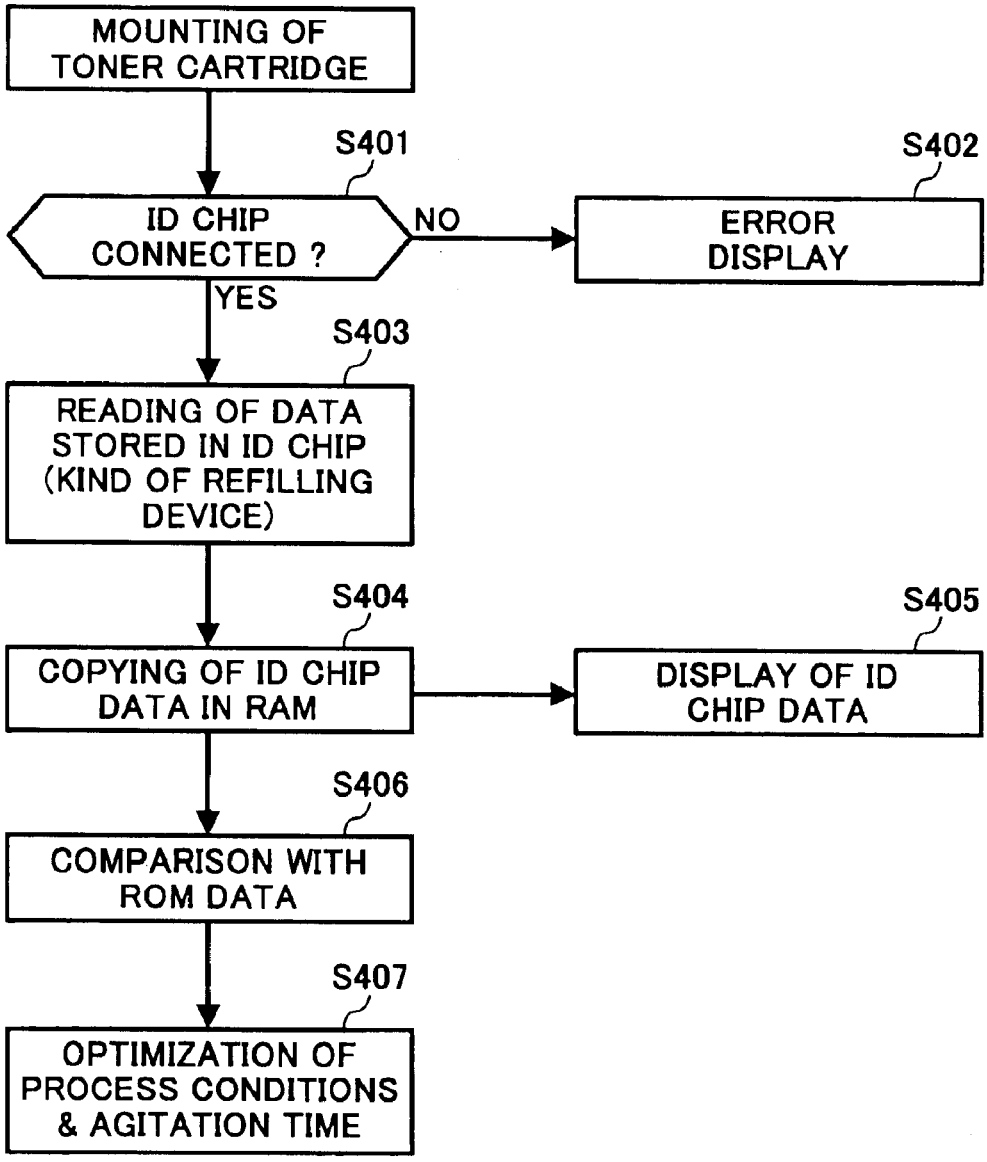

A specific operation to be executed by the third example when the toner container 42 is mounted to the image forming apparatus will be described with reference to FIG. 27. As shown, when the toner container 42 is mounted to the image forming apparatus, the CPU 303 checks the output of the sensor 309 to see if the power supply 308 of the image formation control system 300A is electrically connected to the ID chip 421 or not (step S401). If the answer of the step S401 is NO, then the CPU 303 causes an error message to appear on the display means 306 (step S402) If the answer of the step S301 is YES, then the CPU 303 causes the reading means 301 to read the data stored in the IC chip 421 of the toner container 42 (step S403). The data read out of the ID chip 421 is written to the RAM 304 (step S304) while being displayed on the display means 306 (step S405). The comparator 302 compares data stored in the ROM 305 and the data read out of the ID chip 421 (step S406). The CPU 303 causes the image forming condition setting means 311 to adjust the image forming conditions in accordance with the result of comparison (step S407). This is the end of the procedure executed after the mounting of the toner container 42 to the image forming apparatus.

An image forming apparatus representative of a fourth example of the illustrative embodiment is identical with the first, second or third example except for the following. In the third example, the reading means 301 reads data representative of the date of refilling of the toner container 42 with the toner T. This data is written to the ID chip 421 beforehand when the toner container 42 is refilled with the toner T.

Figure 28:
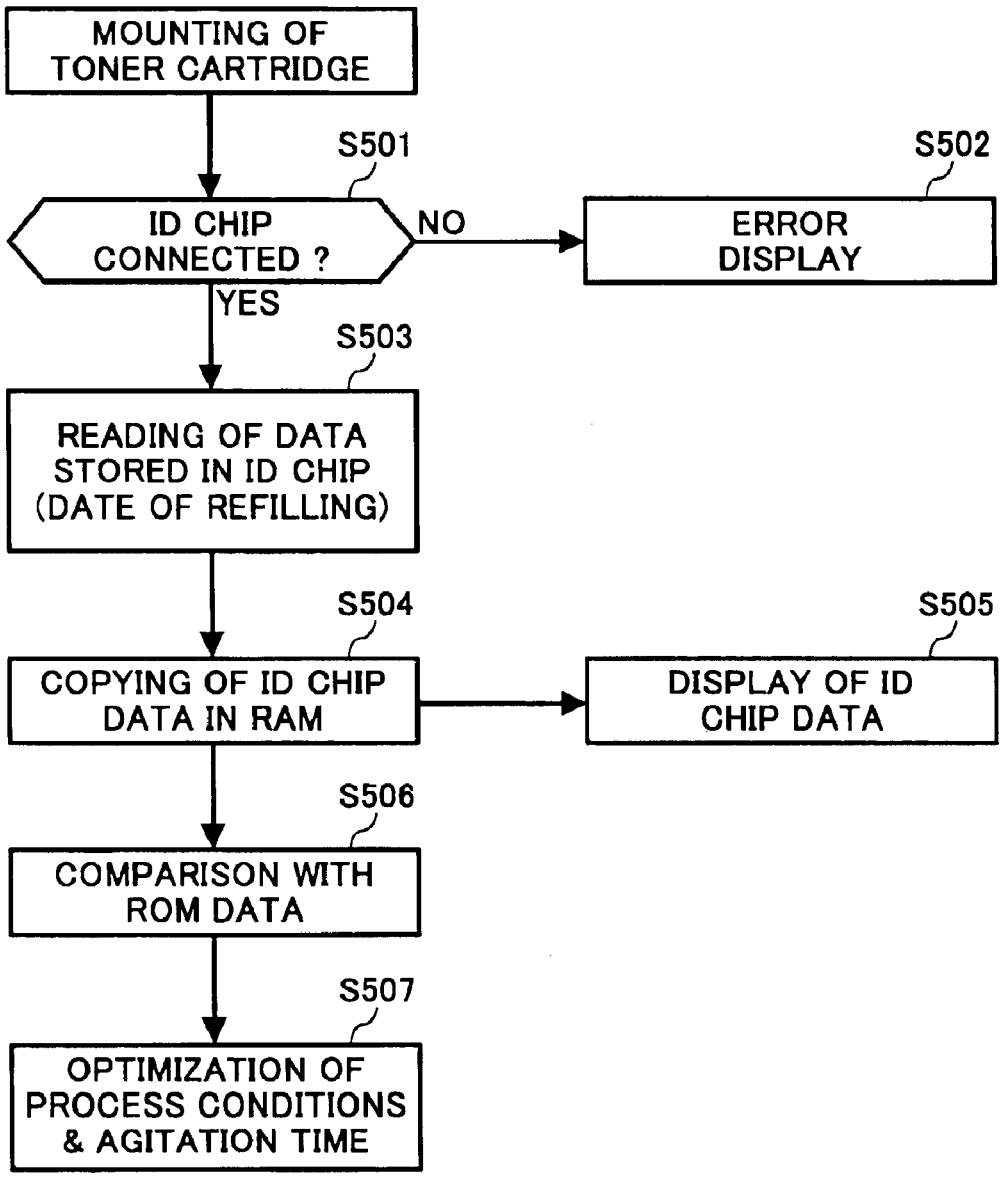

A specific operation to be executed by the fourth example when the toner container 42 is mounted to the image forming apparatus will be described with reference to FIG. 28. As shown, when the toner container 42 is mounted to the image forming apparatus, the CPU 303 checks the output of the sensor 309 to see if the power supply 308 of the image formation control system 300A is electrically connected to the ID chip 421 or not (step S501). If the answer of the step S501 is NO, then the CPU 303 causes an error message to appear on the display means 306 (step S502). If the answer of the step S501 is YES, then the CPU 303 causes the reading means 301 to read the data stored in the IC chip 421 of the toner container 42 (step S503). The data read out of the ID chip 421 is written to the RAM 304 (step S504) while being displayed on the display means 306 (step S405). The comparator 302 compares date data stored in the ROM 305 and the date data read out of the ID chip 421 (step S506). The CPU 303 causes the image forming condition setting means 311 to adjust the image forming conditions in accordance with the result of comparison (step S507). This is the end of the procedure executed after the mounting of the toner container 42 to the image forming apparatus.

An image forming apparatus representative of a fifth example of the illustrative embodiment is identical with the first, second, third or fourth example except for the following. In the third example, the reading means 301 reads data representative of how many times the toner T have been refilled in the toner container 42 in the past. This data is written to the ID chip 421 beforehand when the toner container 42 is refilled with the toner T.

Figure 29:
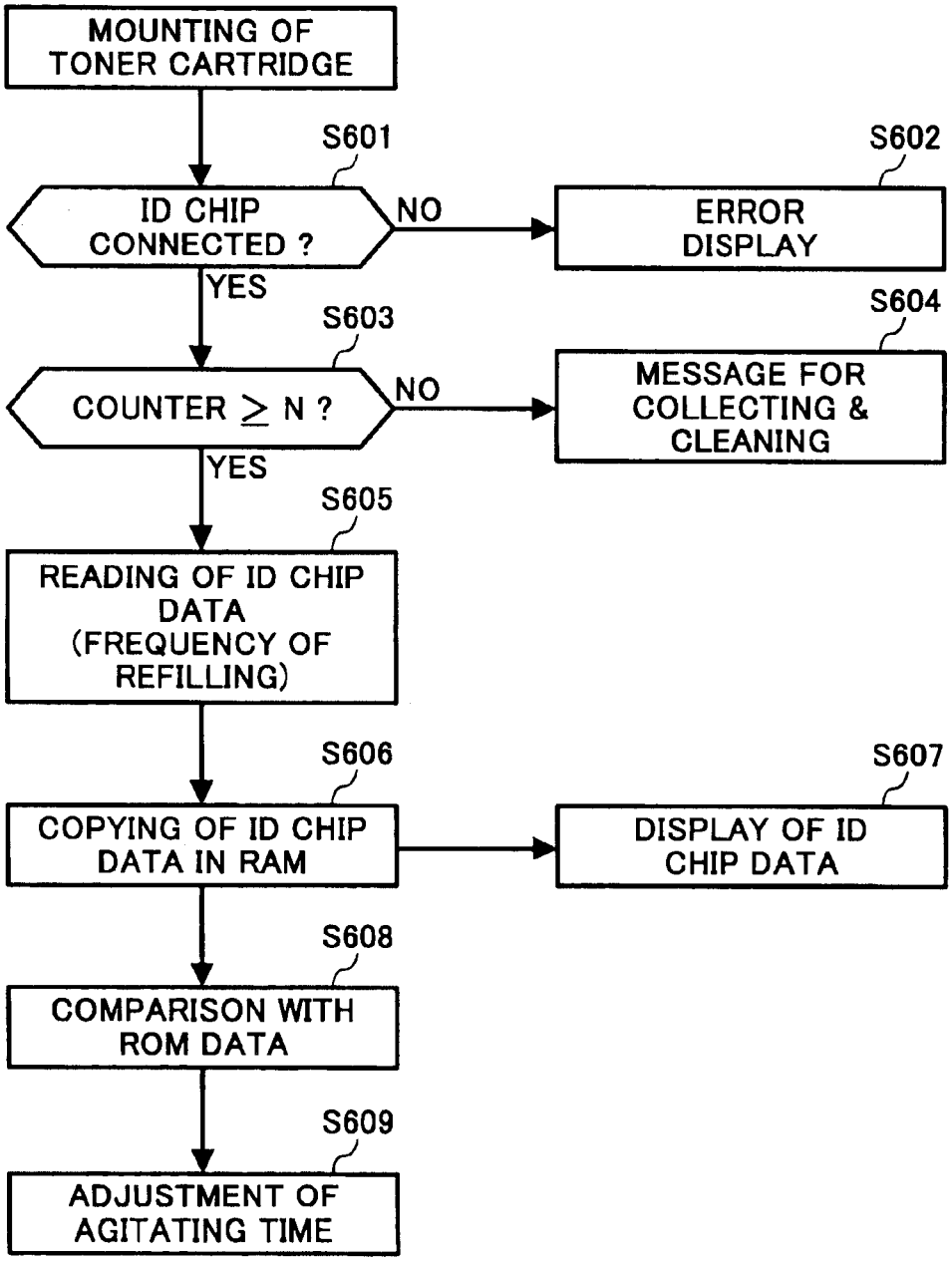

A specific operation to be executed by the fifth example when the toner container 42 is mounted to the image forming apparatus will be described with reference to FIG. 29. As shown, when the toner container 42 is mounted to the image forming apparatus, the CPU 303 checks the output of the sensor 309 to see if the power supply 308 of the image formation control system 300A is electrically connected to the ID chip 421 or not (step S601). If the answer of the step S601 is NO, then the CPU 303 causes an error message to appear on the display means 306 (step S602). If the answer of the step S601 is YES, then the CPU 303 determines whether or not a counter, not shown, for counting how many times the toner container 42 has been mounted to the image forming apparatus is N or above (step S603). If the answer of the step S603 is YES, then the CPU 303 causes a message showing that the toner container 42 should be collected and cleaned to appear on the display 306 (step S604). If the answer of the step S603 is NO, then the CPU 303 causes the reading means 301 to read the data stored in the IC chip 421 of the toner container 42 (step S605). The data read out of the ID chip 421 is written to the RAM 304 (step S604) while being displayed on the display means 306 (step S605). The comparator 302 compares refilling frequency data stored in the ROM 305 and the refilling frequency data read out of the ID chip 421 (step S608). The CPU 303 causes the image forming condition setting means 311 to adjust the image forming conditions in accordance with the result of comparison (step S609). This is the end of the procedure executed after the mounting of the toner container 42 to the image forming apparatus.

An image forming apparatus representative of a sixth example of the illustrative embodiment is identical with the first, second, third, fourth or fifth example except for the following. In the sixth example, the reading means 301 reads data representative of the amount of the toner T refilled in the toner container 42. This data is written to the ID chip 421 beforehand when the toner container 42 is refilled with the toner T.

Figure 30:
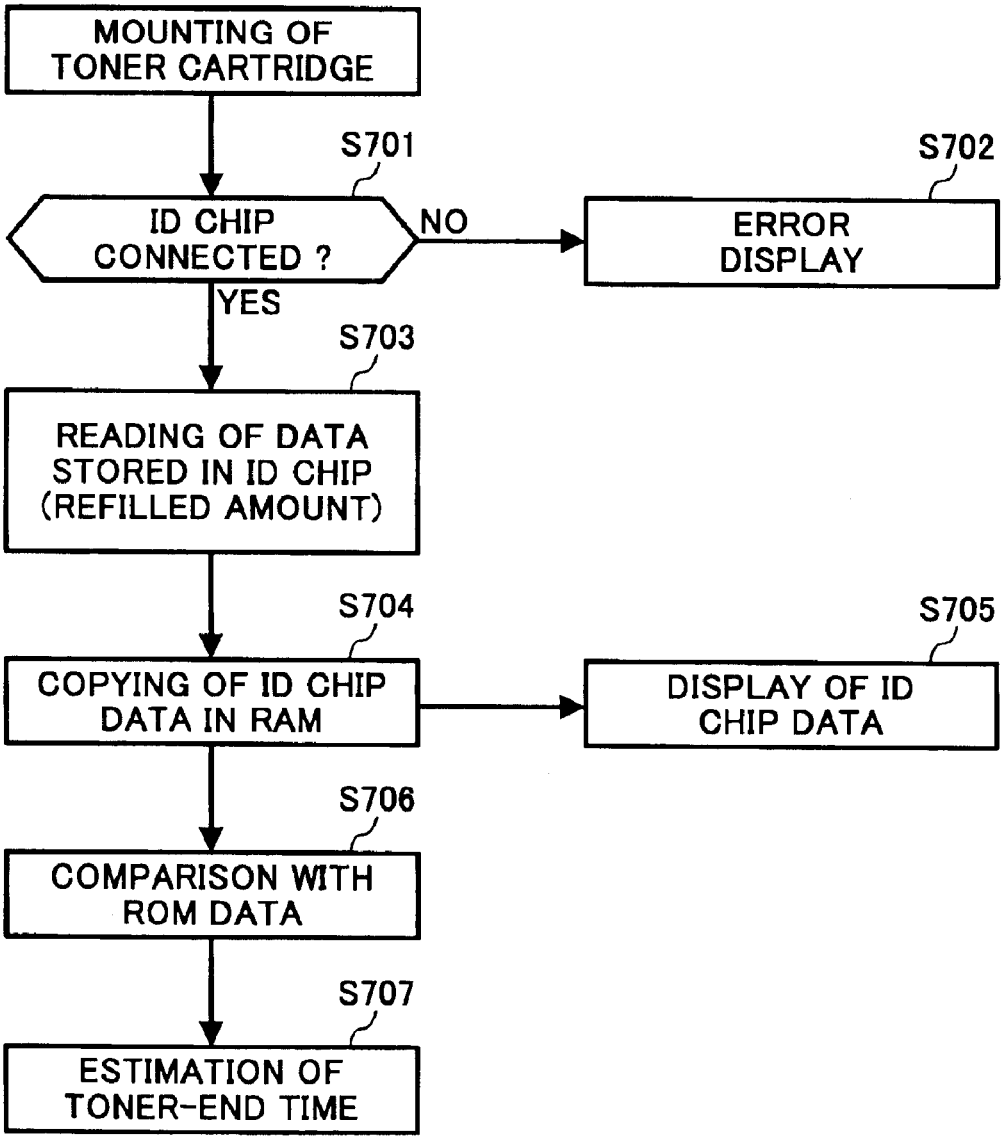

A specific operation to be executed by the sixth example when the toner container 42 is mounted to the image forming apparatus will be described with reference to FIG. 30. As shown, when the toner container 42 is mounted to the image forming apparatus, the CPU 303 checks the output of the sensor 309 to see if the power supply 308 of the image formation control system 300A is electrically connected to the ID chip 421 or not (step S701). If the answer of the step S701 is NO, then the CPU 303 causes an error message to appear on the display means 306 (step S702). If the answer of the step S702 is YES, then the CPU 303 causes the reading means 301 to read the refilled amount data stored in the IC chip 421 of the toner container 42 (step S703). The data read out of the ID chip 421 is written to the RAM 304 (step S704) while being displayed on the display means 306 (step S705). The comparator 302 compares amount data stored in the ROM 305 and the refilled amount data read out of the ID chip 421 (step S706). The CPU 303 estimates the time when the toner container 42 mounted will run out of toner on the basis of the result of comparison (step S707). This is the end of the procedure executed after the mounting of the toner container 42 to the image forming apparatus.

Figure 31:
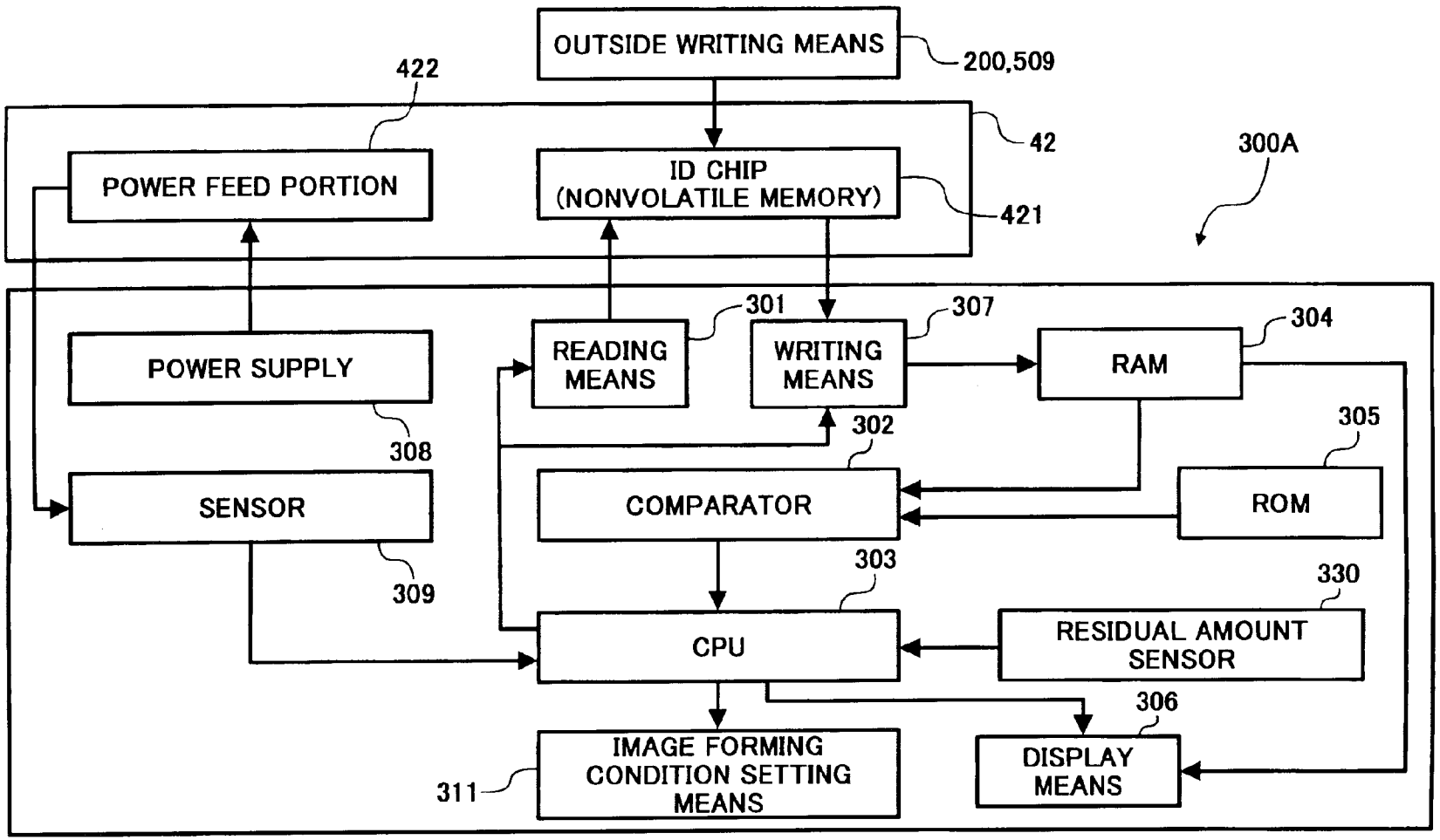
FIG. 31 is a block diagram schematically showing another specific configuration of the image forming control means.

An image forming apparatus representative of a seventh example of the illustrative embodiment is identical with the first example except for the following. As shown in FIG. 31, the seventh embodiment includes writing means 307 for writing in the ID chip 421 data representative of the amount of toner T remaining in the toner container 42.

Figure 32:
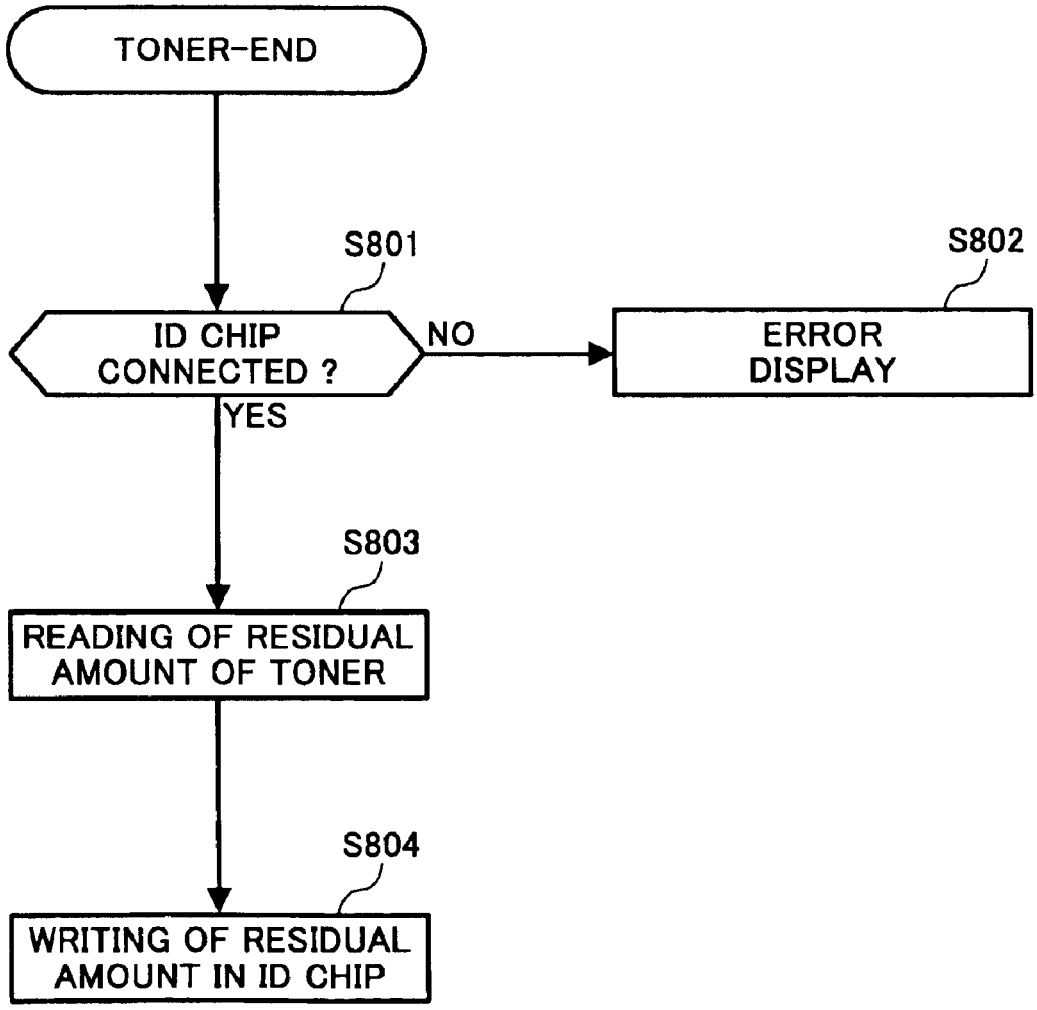
FIG. 32 is a flowchart demonstrating a specific operation of the image formation control means of FIG. 31.

A specific operation to be executed by the seventh example when the toner container 42 is mounted to the image forming apparatus will be described with reference to FIG. 32. As shown, when the toner container 42 is mounted to the image forming apparatus, the CPU 303 checks the output of the sensor 309 to see if the power supply 308 of the image formation control system 300A is electrically connected to the ID chip 421 or not (step S801). If the answer of the step S801 is NO, then the CPU 303 causes an error message to appear on the display means 306 (step S802). If the answer of the step S801 is YES, then the CPU 303 determines the amount of toner T remaining in the toner container 42 in accordance with the output of a residual amount sensor 330 shown in FIG. 31 (step S803). The CPU 303 then causes the writing means 307 to write data representative of the amount of remaining toner in the ID chip 421 of the toner container 42 (step S804). This data will be read out of the ID chip 421 by the reading means 301 when the toner container 42 is to be refilled with the toner T later.

As stated above, the illustrative embodiment achieves various unprecedented advantages, as enumerated below.

(1) When the toner to be refilled in the toner container 42 is not the specified toner, it is inhibited from being refilled in the toner container 42.

(2) Data relating to the toner T refilled in the toner container 42 and stored in the ID chip 421 makes it needless to write new specified toner data at the time of the next refilling operation.

(3) It is possible to accurately determine whether or not the toner T refilled in the toner container 42 is adequate before the toner T is actually replenished. This prevents an inadequate toner container from being mounted to an image forming apparatus.

(4) The kind of the toner refilling device used available contributes to the decision on the kind of the toner T to be used for image formation as well as troubleshooting.

(5) The date of refilling effected with the toner container 42 allows a time elapsed since the last refilling to be known for thereby promoting easy correction of image forming conditions at the time of maintenance.

(6) The number of times of refilling effected in the past allows the time for replacing the toner container 42 to be accurately determined on the basis of a relation between the life of the toner container 24 determined by experiments and the number of times of past refilling. This reduces time and labor for the maintenance of the image forming apparatus.

(7) The time when the toner container 42 will run out of toner can be estimated on the basis of the amount of toner refilled in the toner container 42 and the number of prints output in the past. It is therefore possible to see the time when the toner T in the toner container 42 will become short and therefore to easily make up a schedule for maintenance.

(8) An adequate amount by which the toner T should be refilled in the toner container 42 can be seen at the time of the next refilling operation.

Various modifications will become possible for those skilled in the art after receiving the teachings of the present disclosure without departing from the scope thereof.

What is claimed is:

1. A method of controlling a toner refilling device for refilling a toner container storing specified toner with fresh toner, said method comprising the steps of: providing the toner container with a data storing medium storing specified toner data particular to the specified toner;

reading said specified toner data out of said data storing medium before refilling the toner container with fresh toner;

determining, based on said specified toner data, whether or not the fresh toner to be refilled in the toner container is the specified toner; and controlling, if the fresh toner is not the specified toner, said toner refilling device so as not to refill the toner container with said fresh toner.

2. A control system for controlling a toner refilling device configured to refill fresh toner in a toner container comprising a data storing medium that stores specified toner data particular to specified toner stored in said toner container, said control system comprising: reading means for reading said specified toner data out of the data storing medium before causing the fresh toner to be refilled in the toner container;

comparing means for comparing said specified toner data read out by said reading means and fresh toner data particular to the fresh toner to be refilled;

decision means for determining, based on a result of comparison output from said comparing means, whether or not the fresh toner is the specified toner; and control means for controlling, if the fresh toner is not the specified toner, the toner refilling device so as not to refill the toner container with said fresh toner.

3. The control system as claimed in claim 2, further comprising writing means for writing data in the data storing medium.

* * * * *